US011390494B2

(12) United States Patent
Vehmeijer et al.

(10) Patent No.: US 11,390,494 B2
(45) Date of Patent: Jul. 19, 2022

(54) CRANE AND METHOD FOR POSITIONING AN OBJECT

(71) Applicant: ITREC B.V., Schiedam (NL)

(72) Inventors: Terence Willem August Vehmeijer, Schiedam (NL); Joop Roodenburg, Schiedam (NL); Marc Louis Brinkman, Schiedam (NL)

(73) Assignee: ITREC B.V., Schiedam (NL)

( * ) Notice: Subject to any disclaimer, the term of this patent is extended or adjusted under 35 U.S.C. 154(b) by 40 days.

(21) Appl. No.: 16/966,636

(22) PCT Filed: Feb. 5, 2019

(86) PCT No.: PCT/NL2019/050075
§ 371 (c)(1),
(2) Date: Jul. 31, 2020

(87) PCT Pub. No.: WO2019/156556
PCT Pub. Date: Aug. 15, 2019

(65) Prior Publication Data

US 2021/0032079 A1 Feb. 4, 2021

(30) Foreign Application Priority Data

Feb. 6, 2018 (NL) ..... 2020389

(51) Int. Cl.
*B66C 13/10* (2006.01)
*B66C 13/18* (2006.01)
(Continued)

(52) U.S. Cl.
CPC ..... *B66C 13/10* (2013.01); *B66C 13/18* (2013.01); *B66C 15/02* (2013.01); *B66C 23/52* (2013.01)

(58) Field of Classification Search
CPC ..... B66C 13/10; B66C 13/18; B66C 15/02; B66C 23/52; B66C 23/64; B66C 23/66;
(Continued)

(56) References Cited

U.S. PATENT DOCUMENTS 3,107,791 A * 10/1963 Michael ..... B66C 23/66 254/297
3,353,687 A * 11/1967 Thomson ..... B66C 23/605 212/239
(Continued)

FOREIGN PATENT DOCUMENTS

CN 106865415 A 6/2017
EP 2 490 975 A1 8/2012
(Continued)

OTHER PUBLICATIONS

Dutch Search Report, issued in Priority Application No. 2020389, dated Oct. 19, 2018.
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A wave-induced motion compensating crane includes a hoist assembly. At least two departure sheaves are mounted at opposite lateral sides of the jib. The object suspension device is supported both by two hoist cables extending laterally from the jib and a third hoist cable that runs via another departure sheave. The hoist assembly is adapted to hoist and/or lower the object suspension device with an object connected thereto, between a lower position and a position at a height up to the departure sheaves while the
(Continued)

hoist cables together define a reverse pyramid, diverging upwards in between the object suspension device and the departure sheaves.

11 Claims, 7 Drawing Sheets

(51) Int. Cl.
*B66C 15/02* (2006.01)
*B66C 23/52* (2006.01)

(58) Field of Classification Search
CPC ..... B66C 23/06; B66C 23/18; B66C 23/36; B66C 23/62
See application file for complete search history.

(56) References Cited

U.S. PATENT DOCUMENTS 3,591,022 A 7/1971 Polyakov et al.
4,221,300 A * 9/1980 Rudak ..... B66C 23/52 212/347
2008/0216301 A1 9/2008 Hansen et al.
2011/0094987 A1 4/2011 Botwright et al.
2012/0156003 A1* 6/2012 Battersby ..... B66C 23/52 414/803
2016/0002010 A1 1/2016 May et al.
2016/0332849 A1* 11/2016 Roodenburg ..... B66C 23/64
2018/0044148 A1* 2/2018 Roodenburg ..... B66C 23/52

FOREIGN PATENT DOCUMENTS

JP 6-31156 B2 4/1994
JP 2507856 B2 6/1996
WO WO 2015/105414 A1 7/2015

OTHER PUBLICATIONS

International Search Report, issued in PCT/NL2019/050075, dated Jul. 9, 2019.
Written Opinion of the International Searching Authority, issued in PCT/NL2019/050075, dated July 9, 2019.

* cited by examiner

CRANE AND METHOD FOR POSITIONING AN OBJECT

FIELD OF THE INVENTION

The invention relates to the field of cranes. For example very tall cranes are nowadays envisaged for use in offshore windfarms, e.g. in view of handling wind turbine components. For example, the nacelle of a wind turbine may comprise components like a gearbox and/or generator, etc., that may need replacement in case of malfunctioning. The same holds for the blades of a wind turbine.

Nowadays windfarm installation and maintenance is often done from jack-up vessels, wherein the lifted hull provides a stable base for the one or more cranes on such a jack-up vessel. Nonetheless, influences like wind, bending of the main boom of the crane under the load, etc., entail that lifting jobs are often restricted or difficult to perform. Even more demanding in this regard is the use of a non-jack-up vessel, or a jack-up vessel in floating condition, with a tall crane thereon to perform such activities.

A known crane used to transfer objects from and to a vessel comprises a revolving superstructure, a boom, e.g. lattice boom, pivotally mounted to the revolving superstructure, e.g. to a foot portion thereof, a luffing assembly, and a hoist assembly. Therein the boom comprises a main boom and a jib.

The main boom comprises firstly a main boom member, e.g. a latticed main boom member, the lower end of which is pivotally mounted about a first pivot axis to the superstructure. It may secondly comprise a main boom strut, an end of which is mounted to an upper end of the main boom member and extending essentially perpendicular to the main boom member, and may thirdly comprise a boom stay extending between the main boom strut and a lower portion of the main boom member.

The jib is pivotally mounted about a second pivot axis to the main boom. It comprises firstly a jib member, e.g. a latticed jib member, an inner end of which is pivotally mounted to the upper end of the main boom member. It may secondly comprise a jib strut, an end of which is mounted to an inner end of the jib member and extending essentially perpendicular to the jib member, and may thirdly comprise a jib stay extending between the jib strut and the jib member.

In embodiments comprising the struts and stays, the boom further comprises a variable length stay mechanism, which is provided between the main boom strut and the jib strut. In these embodiments the luffing assembly comprises a luffing winch mounted to the superstructure, and a luffing cable extending between the luffing winch and the main boom.

The hoist assembly comprises firstly a hoist winch, and secondly a hoist cable, extending from the hoist winch along the main boom and the jib via a jib departure sheave, e.g. on or close to the free end of the jib member, to an object suspension device. The hoist winch is provided with heave compensation, e.g. by embodying the hoist winch as an AHC winch or by means of heave compensating cylinders operating on the unwound section of the hoist cable. The object suspension device is with an upper part thereof connected to the hoist cable and with a lower part to an object to be transferred by the crane.

OBJECT OF THE INVENTION

When transferring an object using the crane, wave-induced motion of the vessel and/or wind may force an object to be hoisted into a pendulous action, causing it to swing unchecked. A prior art solution to this problem is to compensate the wave-induced motion of the vessel by operating the crane accordingly—i.e. the crane motions normally used to position an object suspension device/object are then used for wave-induced motion compensation. Thereto the hoist cable is commonly provided with heave compensation functionality, e.g. by embodying the hoist winch as an AHC (active heave compensated) winch or by means of one or more heave compensating cylinders operating on a section of the hoist cable. Motion compensation may also involve the slew and luffing system of the crane. The compensation hereby achieved is however not capable prevent the load from swinging.

In positioning of objects handled by a crane, it is common to attach tugger cables to the hoisted object, or the object suspension device, for rotating it around the load bearing cable of the crane and/or translate it in the horizontal plane thereof, e.g. to compensate and/or correct unwanted motions thereof in the horizontal plane. For this purpose, the tugger cables run generally horizontally to the boom, e.g. via main boom departure sheaves, to one or more tugger winches. The capacity of the tugger winches is generally low compared to that of the main hoist winch of the crane as the tuggers do not carry the weight of the load. Examples are disclosed by JP2507856, JPH0631156, EP2490975 and US2008216301. Therein, the tugger cable sheaves are movable along the main boom member, so to maintain the horizontal orientation of the tugger cables.

SUMMARY OF THE INVENTION

In a first aspect thereof, the present invention aims to propose an improved crane, e.g. for use on a vessel, e.g. on a jack-up vessel. Herein the crane comprises a hoisting system, which hoisting system comprises one or more hoist winches, and both a main boom hoist assembly and a jib hoist assembly.

The main boom hoist assembly comprises two main boom departure sheaves, and two main boom hoist cables. The two main boom hoist cables are configured to extend from the, or one or two of the, hoist winches along the main boom member via the main boom departure sheaves to the object suspension device. This may be accomplished through a single-fall arrangement of these hoist cables, or through a multiple-fall arrangement.

In a particular embodiment, the main boom hoist cables may be arranged in a double-fall arrangement. Herein the main boom hoist assembly comprises two pairs of main boom departure sheaves. Each pair of main boom departure sheaves is therein mounted to an upper end of the main boom member at opposite lateral sides thereof. The main boom hoist assembly therein further comprises two main boom spreader sheaves, each connected to the object suspension device, e.g. via a respective spreader cable or e.g. by means of a respective spreader beam.

The main boom hoist cables are each configured to extend from one of the hoist winches along the main boom member successively via one main boom departure sheave of a respective pair of main boom departure sheaves, a respective one of the two main boom spreader sheaves, the other main boom departure sheave of the respective pair of main boom departure sheaves to the one of the hoist winches.

Furthermore the jib hoist cable may be arranged in a double-fall arrangement. Therein the jib hoist assembly comprises a pair of jib hoist sheaves, mounted to the jib member, e.g. to the free end thereof. The jib hoist assembly therein further comprises a jib spreader sheave, connected to the object suspension device, e.g. via a spreader cable or e.g. by means of a spreader beam.

The jib hoist cable is configured to extend from one of the hoist winches along the main boom and the jib successively via one jib departure sheave of the pair of jib hoist sheaves, the jib spreader sheave, the other jib hoist sheave of the pair of jib hoist sheaves to the one of the hoist winches.

The main boom hoist assembly further comprises a main boom hoist heave compensation mechanism. Herein, e.g., the hoist winch(es) from which the main boom hoist cables extend are embodied as AHC (active heave compensated) winches, or, e.g., the main boom hoist heave compensation mechanism comprises a heave compensating cylinder operating on a section of the main boom hoist cable.

The jib hoist assembly comprises a jib hoist departure sheave, and a jib hoist cable. The jib hoist cable is configured to extend from the, or one of the, one or more hoist winches along the main boom member and the jib member via the jib departure sheave(s) to the object suspension device, e.g. in a single-fall arrangement or in a multiple-fall arrangement. The jib hoist assembly further comprises a jib hoist heave compensation mechanism, e.g. wherein the hoist winch from which the jib hoist cable extends is embodied as an AHC winch, or wherein the jib hoist heave compensation mechanism comprises a heave compensating cylinder operating on a section, e.g. the unwound section, of the jib hoist cable.

The object suspension device is supported by the jib hoist cable and by the two main boom hoist cables, e.g. with an upper part thereof connected or connectable to the main boom hoist cables and the jib hoist cable, and with a lower part to an object to be transferred by the crane.

The two main boom departure sheaves are connected to the upper end of the main boom member at opposite lateral sides thereof.

In an embodiment the main boom departure sheaves are mounted to lateral ends of a transverse beam. Therein the transverse beam is at a center portion thereof mounted to the upper end of the main boom member, e.g. substantially at the height of the second pivot axis, e.g. directly below the second pivot axis. Therein, the length of the transverse beam, e.g. substantially corresponding to the lateral distance between the two main boom departure sheaves, is e.g. in the range of 8-30 meter, e.g. 12 meter.

In an embodiment the crane further comprises two boom extensions, e.g. forming an additional jib strut in addition to the already provided jib strut, each provided with a separate cable running over the upper end thereof. Lower ends of the two boom extensions are therein connected to the upper end of the main boom member. The boom extensions extend from said upper end at equal upward angles, e.g. between 60 and 90°, relative to the horizontal. The boom extensions diverge from each other and from the jib, e.g. at a mutual angle of between 40 and 80°, e.g. preferably around 60°, when seen in a top view of the crane. Therein each of the main boom departure sheaves are mounted to a respective upper end of the boom extensions.

As enabled by the mounting of the two main boom departure sheaves to the upper end of the main boom member at opposite lateral sides thereof, the main boom hoist assembly is adapted to, together with the jib hoist assembly, hoist the object suspension device with an object connected thereto, up to the height of the main boom departure sheaves while the jib hoist cable and the main boom hoist cables together define a reverse pyramid diverging upwards from the object suspension device.

This inventive arrangement of the main boom hoist assembly having hoisting capability in cooperation with the jib hoist assembly, enables that up to the height of the main boom departure sheaves, by controlling the paying out and/or drawing in of the jib hoist cable and two main boom hoist cables in coordination with one another, e.g. software-based, the position of the object may be more effectively controlled, and over a larger range of horizontal positions for a certain height, than in prior art tugger systems without this hoisting capability of the tugger cables. Therein the earlier mentioned rotations and translations of the object, in the prior art established by the main boom hoist assembly generally independently of the vertical motions established by the jib hoist assembly, are now established by the main boom hoist assembly and the jib hoist assembly together, in cooperation with each other, and in dependence of the vertical motions of the object established by these same assemblies together.

The jib hoist cable and the two main boom hoist cables define a reverse pyramid having a triangular base which reduces, e.g. substantially avoids, swinging of the load, which allows for a more accurate positioning by adjusting the length of the paid out section of the respective cables.

For instance, in practical use of the crane, the horizontal distance between the object and a stationary object outside the vessel, e.g. a wind turbine, and/or between the object and the vessel itself, e.g. the main boom of the crane, may be altered without pivoting the jib—namely by merely adjusting the ratio between the length of the main boom hoist cables being paid out or drawn in and the length of the jib hoist cable being paid out or drawn in. Therein, by furthermore dependently controlling this ratio in dependence of the height of the object suspension device during hoisting, this distance may be kept constant, so to e.g. hoist the object over a vertical line.

By adjusting the jib relative to the main boom, e.g. using a variable length stay mechanism between a main boom strut and a jib strut, the shape of the inverted pyramid may be adjusted in favour of optimization of the hoisting job.

In embodiments the jib hoist is embodied and operable as a truly independent jib hoist system when disconnected from the two cables from the main hoist assembly. This may allow for the jib hoist to be operated in stand-alone mode. This allows for maximum hoisting height.

According to at least the first aspect of the invention the vertical load of the object is distributed over the three hoist cables, which may e.g. be advantageous in terms of efficiency and/or speed while hoisting up to this height, in particular when hoisting heavy objects.

Preferably, the main boom hoist assembly is furthermore adapted to for controlling horizontal components of movements of the object suspension device with an object connected thereto up to a height of the object suspension device directly below the jib departure sheave. Therein, when the jib is at an upward angle relative to the horizontal and the object suspension device is at a height in between the main boom departure sheaves and the jib departure sheave, the main boom hoist cables cannot be used for hoisting as these then extend upwardly to the object suspension device. However, at this height paying out and/or drawing in the main boom hoist cables may still effectuate substantially horizontal movements of the object suspension device and the object. Therein these function alike the prior art tugger cables.

In a practical use of the crane, heavier objects may be hoisted or lowered over the same height with the same bending moment around the first pivot axis, e.g. twice as heavy, as with prior art systems employing tugger assemblies without hoisting capabilities and heave compensation.

The inventive arrangement of the main boom hoist assembly and the jib hoist assembly according to at least the first aspect of the invention enables that the object is hoisted and/or lowered along a trajectory which has a smaller horizontal distance from the first pivot axis than the departure sheave, e.g. below a center portion of the jib, e.g. below the middle of the jib, instead of substantially below the main boom departure sheave such as in prior art systems. This applies when the object is at a height up to substantially the height of the main boom departure sheaves, wherein the main boom hoist cables and the jib hoist cables together, as well as a height above the main boom departure sheaves in which the jib is at an upwards angle relative to the horizontal.

The inventive arrangement of the main boom hoist assembly and the jib hoist assembly enables that for the same weight of the object, the crane is advantageously subjected to less bending stresses. Correspondingly, a heavier weight may advantageously be hoisted or lowered by the crane without increasing, e.g. while even decreasing, the bending stress the crane is subjected to.

In an embodiment of the crane, the one or more hoist winches consist of one single hoist winch, e.g. wherein the jib hoist heave compensation mechanism and the main boom hoist heave compensation mechanism comprise cylinders operating on the unwound section of the jib hoist cable and the main hoist cables, respectively.

In another embodiment, the one or more hoist winches comprise one jib hoist winch and one main boom hoist winch, the jib hoist cable extending from the jib hoist winch, and the two main boom hoist cables from the one main boom hoist winch.

In a still other embodiment, the one or more hoist winches consist of one jib hoist winch and two main boom hoist winches, the jib hoist cable extending from the jib hoist winch, and the two main boom hoist cables each from a respective one of the two main boom hoist winches.

In embodiments in which one or two main boom hoist winches are present, at least these winches may be embodied as AHC winches, e.g. comprised by the main boom hoist heave compensation system. Alternatively any hoist cable may be heave compensated by means of heave compensating cylinders operating on the unwound section of the hoist cable.

Preferably, the crane is provided with a control device, e.g. configured to control operation of the luffing assembly and/or any variable length say mechanism when present.

In a practical embodiment the length of the main boom can be at least 50 meters.

In embodiments in which one or two main boom hoist winches and a jib hoist winch are present, the control device is preferably programmed to operate the main boom hoist winches and jib hoist winches, e.g. embodied as AHC (active heave compensated) winches, so as to control the position and/or velocity of the object by simultaneously paying out and/or drawing in of the jib hoist cable and the main boom hoist cables in dependence of one another, e.g. in a (pre)determined constant or dynamic ratio.

The operation of the hoist winches may, furthermore or alternatively, also be so as to control the position and/or velocity of the object e.g. based on a predetermined trajectory and/or reference positions, and/or e.g. in dependence of the actual vertical and/or horizontal position and/or orientation and/or motions of the object and/or the object suspension device and/or the vessel and/or the crane, e.g. by feedback and/or feedforward control based on live measurements by sensors providing actual data on the position and/or orientation and/or motions of the object to the control device.

The crane also allows to deal with any motion of the crane itself, e.g. periodic bending of the boom due to wind effects, etc.

In an embodiment the winches are operated to provide damping effects on any pendulous motion of the object suspension device and object suspended therefrom.

In an embodiment the object suspension device is provided with a sensor, e.g. radar, adapted to determine the position thereof relative to one or more beacons. For example a beacon is mounted on a nacelle or top of the mast of a wind turbine, so that the object suspension device is directly correlated as to its position relative to the nacelle and/or top of the mast. Hereby any motions of the mast and/or nacelle are directly accounted for in the control of the crane during lifting or lowering of a wind turbine component. It will be appreciated that this provision of sensor and one or more beacons may also be applied for other types of offshore windfarm cranes.

The control device is preferably also programmed to operate the main boom hoist winches and jib hoist winches separately and/or independently, e.g. to separately and/or independently control horizontal and vertical movement components of the object.

In an embodiment, the object suspension device is provided, preferably at its outer side surface above the connection of the object suspension device with the object, with at least two cable connectors to which each of the main boom hoist cables and the jib hoist cable are respectively connected or connectable, preferably provided with three cable connectors of which each is connected to a respective one of the main boom hoist cables and jib hoist cable. These cable connectors form the points of application for the hoisting and/or tugging forces exerted thereon by the cables. Therein the cable connectors are preferably provided at equal mutual angles around a central vertical axis of the object suspension device, preferably three cable connectors being provided at a mutual angle of 60° around said central vertical axis. Furthermore therein the cable connectors e.g. comprise eyelets, directed outwards in a vertical plane.

In an embodiment, the main boom hoist assembly comprises two main boom hoist winches, from each of which a respective one of the two main boom hoist cables extends. In this embodiment, the main boom hoist winches are operable separately, e.g. by the control device which is therein programmed to do so, such as to have a different length of main boom hoist cable unwounded, so that the object is positioned in a position which, and/or hoisted and/or lowered along a trajectory which, in a top view of the crane, at least partly, extends laterally of the jib.

Preferably, the cable connectors are pivotable around a vertical pivot axis. This enables to align the cable connectors such that the cables point to a center axis of the object suspension device, so as to ensure that the load remains suspended directly below the object suspension device.

Preferably, a lower part of the object suspension device connected to the object is rotatable relative to an upper part of the object suspension device connected to the jib hoist cable and/or the main boom hoist cables, so that the object is rotatable around the central vertical axis of the object suspension device. Therein preferably, in case the control device is present, the rotation of said lower part relative to said upper part is controllable by means of the control device, so that the angular position of the object in its horizontal plane is controllable thereby.

Preferably, the main boom hoist cable(s) and/or jib hoist cable are connected to the object suspension device with respective terminal ends thereof.

In an embodiment, the connection between the main boom hoist cables and the object and/or the object suspension device is releasable, e.g. by means of the control device. This enables that the main boom hoist cables are disconnected from the object and/or the object suspension device, so that the jib hoist assembly is usable as a second hoist, wherein the object connector device is solely connected to the jib hoist cable, and the main boom hoist cable is usable as a first hoist. The first hoist is capable of hoisting and/or lowering objects between a lower position and a position at a height up to the height of the main boom departure sheaves. The second hoist is capable of, e.g. simultaneously, hoisting and/or lowering objects between a lower position and a position at a height up to the height of the main boom departure sheaves.

In an embodiment, the connection between the jib hoist cable and the object and/or the object suspension device, is releasable, e.g. by means of the control device. Based on the hoisting capability of the main boom hoist assembly this enables that the jib hoist cable is disconnected from the object and/or the object suspension device, so that the main boom hoist assembly is usable as a first hoist, wherein the object connector device is solely connected to the main boom hoist cables, and the jib hoist assembly is usable as a second hoist. The first hoist is capable of hoisting and/or lowering objects between a lower position and a position at a height up to the height of the main boom departure sheaves. The second hoist is capable of, e.g. simultaneously, hoisting and/or lowering objects between a lower position and a position at a height up to the height of the main boom departure sheaves. Therein, the connection between one or both of the main boom hoist cables and the object and/or the object suspension device may also be releasable, so that the object suspension device may be disconnected from one of the main boom hoist cables so as to be suspended from a single main boom hoist cable only, e.g. wherein each main boom hoist cable extends from a separate main boom hoist winch.

In an embodiment, the connection between the jib hoist cable and the object and/or the object suspension device, as well as the connection between the jib hoist cable and the object and/or the object suspension device, is releasable, e.g. by means of the control device.

According to any embodiment of the invention in which the connection between the jib hoist cable and the object and/or the object suspension device, and/or the connection between the jib hoist cable and the object and/or the object suspension device, is releasable, advantageously three fully valuable hoists are provided which are controllable to cooperate with each other for precisely and controllably positioning the object suspension device and the attached object, and controllable to be used in other configurations, e.g. in which the hoists operate separately or wherein one of the main boom hoist assembly and the jib hoist cable fulfils the function of hoisting, and the other one that of tuggering.

In a second aspect thereof, the present invention aims to propose a wave-induced motion compensating crane provided with a three-point cable suspension mechanism. This crane according to claim 8, may, e.g., be configured for use on a vessel, e.g. a floating vessel.

The crane comprises firstly a boom comprising a main boom. The main boom comprises a main boom member, the lower end of which is pivotally mounted about a first pivot axis with respect to the vessel.

The crane secondly comprises a jib, which is pivotally mounted about a second pivot axis to the main boom, and comprises a jib member. An inner end of this jib member is pivotally mounted to the upper end of the main boom member.

It thirdly comprises a luffing assembly for luffing the main boom, and a jib pivot angle adjustment mechanism.

Fourthly an object suspension device is provided, to which an object is connected or connectable underneath the object suspension device.

Therein the three-point cable suspension mechanism comprises three hoisting systems and a heave compensation mechanism.

Each hoisting system comprising a hoist winch, two departure sheaves, a hoist cable, a spreader sheave, and two mobile guide sheaves.

As a heave compensation mechanism, one or more of the hoist winches of the hoisting systems may e.g. be embodied as an AHC winch, or e.g. the hoist assembly may comprise heave compensating cylinders operating on the unwound section of the hoist cables of the hoisting systems.

The hoisting cable of each hoisting system extends from the hoist winch thereof, successively via one of the two mobile guide sheaves thereof, one of the departure sheaves thereof, the spreader sheave thereof, the other one of the two departure sheaves thereof, and the other one of the two mobile guide sheaves thereof to the hoist winch thereof.

Each of the two mobile guide sheaves of each hoisting system is interconnected to a mobile guide sheave of the two other hoisting systems such that its rotational axis is parallel to that of the mobile guide sheave connected thereto, and is mounted to the crane such as to be movable with respect thereto in a direction perpendicular to its rotational axis, and towards or away from an adjacent departure sheave of its hoisting system.

The departure sheaves are mounted to an upper part of the crane, e.g. the jib and/or an upper end of the main boom, such as to have at least two of the three departure sheaves positioned at opposite lateral sides from the jib, so that the departure sheaves and the mobile guide sheaves define a triangle when seen in a top view of the crane.

The spreader sheaves are each connected to the object suspension device, the spreader sheaves therein radially surrounding the object suspension device.

The three-point cable suspension mechanism is adapted to hoist and/or lower the object suspension device with an object connected thereto between a lower position and a position at a height up to just below the three departure sheaves while the three hoist cables together define a reverse pyramid diverging upwards in between the object suspension device and the three departure sheaves.

This is established in a way such that any difference in cable tension between the three hoist cables results in a movement of one or more of the interconnected guide sheaves towards or away from the adjacent departure sheaves so as to cancel out said difference in cable tension.

The crane may furthermore be provided with a control device, programmed to operate the three hoist winches so as to control the position and/or velocity of the object by simultaneously paying out and/or drawing in of the three hoist cables in dependence of the vertical and/or horizontal position and/or motions of the object and/or the object suspension device and/or the vessel and/or the crane.

The control device may furthermore be programmed to operate the three hoist winches so as to simultaneously differently pay out and/or draw in the three hoist cables in reaction to, e.g. in dependence of, any difference in cable tension between the three hoist cables, thereby controlling movement of one or more of the interconnected guide sheaves towards or away from the adjacent departure sheaves so as to cancel out said difference in cable tension.

The one or more spreaders, e.g. three horizontal beams, are optionally be provided in between the object suspension device and the spreader sheaves so as to determine a radial distance between the central vertical axis of the object suspension device and each spreader sheave.

In a third aspect thereof, the current invention aims to propose a crane provided with a three-point cable suspension mechanism. This crane corresponds to claim 11, and is, e.g., suitable for use on a floating vessel.

This crane of the third aspect comprises firstly a boom comprising a main boom. The main boom comprises a main boom member, the lower end of which is pivotally mounted about a first pivot axis with respect to the vessel.

The crane secondly comprises a jib, which is pivotally mounted about a second pivot axis to the main boom, and comprises a jib member. An inner end of this jib member is pivotally mounted to the upper end of the main boom member.

It thirdly comprises a luffing assembly for luffing the main boom, and a jib pivot angle adjustment mechanism to adjust the pivot angle of the jib relative to the main boom, and fourthly an object suspension device, to which an object is connected or connectable underneath the object suspension device.

Herein the three-point cable suspension mechanism comprises a hoist assembly. This hoist assembly firstly comprises two or three hoist winches, and secondly three departure sheaves mounted to an upper part of the crane at a hoisting height, e.g. to the jib and/or the upper end of the main boom. It thirdly comprises three hoist cables, each extending from the, or one of the, two or three hoist winches, along the boom and optionally the jib via a respective departure sheave to the object suspension device. The three hoist cables together support the object suspension device. It fourthly comprises a heave compensation mechanism, e.g. wherein one or more of the hoist winches are embodied as an AHC winch, or wherein the hoist assembly comprises heave compensating cylinders operating on the unwound section of the hoist cables.

The departure sheaves are mounted to the crane such as to have at least two of the three departure sheaves positioned at opposite lateral sides from the jib.

The hoist assembly is adapted to hoist and/or lower the object suspension device with an object connected thereto between a lower position and a position at a height up to just below the departure sheaves while the hoist cables together define a reverse pyramid diverging upwards in between the object suspension device and the three departure sheaves.

The crane is furthermore provided with a control device, programmed to operate the two or three hoist so as to control the position and/or velocity of the object by simultaneously paying out and/or drawing in of the three hoist cables in dependence of the vertical and/or horizontal position and/or motions of the object and/or the object suspension device and/or the vessel and/or the crane.

Cranes that correspond to the second and/or the third aspect of the invention, may further comprise a platform mounted to the jib, e.g. mounted movably with respect to the jib, e.g. directly below or directly above the jib. This platform therein supports the three departure sheaves.

The following features apply to cranes according to the second and third aspect of the invention, though these have been described in relation to the crane according to the first aspect of the invention. The specific explanation thereof as well as any effects and/or advantages thereof may be derived from the explanation in relation to the first aspect, and are therefore not repeated below.

In embodiments, two of the three departure sheaves may be mounted to lateral ends of a transverse beam, which transverse beam is at a center portion thereof mounted to the upper end of the main boom member, or to the jib, e.g. to or close to the inner end of the jib.

In embodiments, the crane further comprises two boom extensions, each having a lower end thereof connected to the upper end of the main boom member. The boom extensions extend from this upper end at equal upward angles relative to the horizontal and diverging from each other and from the jib when seen in a top view of the crane. Therein two of the three departure sheaves are mounted to a respective upper end of the boom extensions. The other departure sheave is preferably provided to the jib, particularly preferably to the free end of the jib.

In embodiments at least one of the two or three hoist winches of the crane is embodied as an AHC winch.

In other embodiments at least one of the three hoist cables are heave compensated by means of heave compensating cylinders operating on the unwound section of each hoist cable.

In embodiments the control device is programmed to operate the hoist winches so as to control the position and/or velocity of the object by simultaneously paying out and/or drawing in of the hoist cables in dependence of one another, e.g. in a (pre)determined constant or dynamic ratio.

In embodiments the control device is furthermore programmed to operate the hoist winches separately and/or independently, e.g. to separately and/or independently control horizontal and vertical movement components of the object.

In embodiments the control device is furthermore programmed to operate the hoist winches based on a predetermined trajectory and/or one or more reference positions of the object.

In embodiments the control device is furthermore programmed to operate the hoist winches in dependence of the vertical and/or horizontal position and/or orientation and/or motions of the object and/or the object suspension device and/or the hoist cables and/or the vessel and/or the crane.

In embodiments the control device is furthermore programmed to operate the hoist winches by feedback control and/or feedforward control based on live measurements by sensors providing actual data on the position and/or orientation and/or motions of object and/or the object suspension device and/or the hoist cables and/or the vessel and/or the crane to the control device.

In preferred embodiments the object suspension device is provided, preferably at its outer side surface above the connection of the object suspension device with the object, with cable connectors, preferably three cable connectors. To each of these cable connectors a respective hoist cable is connectable or connected, preferably provided at equal mutual angles around a central vertical axis of the object suspension device.

Therein the cable connectors may be pivotable around a respective vertical pivot axis.

In preferred embodiments lower part of the object suspension device connected to the object is rotatable relative to an upper part of the object suspension device connected to the hoist cables, so that the object is rotatable around the central vertical axis of the object suspension device. Therein the rotation of the lower part relative to the upper part is preferably controllable by means of the control device, if present, so that the angular position of the object in its horizontal plane is controllable thereby.

In preferred embodiments the connection between one or more of the hoist cables and the object and/or the object suspension device is releasable.

In embodiments the hoist cables are connected to the object suspension device with respective terminal ends thereof.

In a fourth aspect thereof, the present invention further aims to propose a method for positioning an object suspended from a wave-induced motion compensating crane. Therein the wave-induced motion compensating crane corresponds to the first aspect of the invention.

The method of the fourth aspect comprises the operation of the hoist winches such as to, synchronously, hoist and/or lower the object suspension device with an object connected thereto between a lower position and a position at a height up to substantially the height of the main boom departure sheaves while the jib hoist cables and the main boom hoist cables together define a reverse pyramid that diverges upwards from the object suspension device.

In an embodiment the method of the fourth aspect comprises, by operating the hoist winch(es), hoisting and/or lowering the object in between a lower position and a position at a height up to the height of the main boom departure sheaves by paying out and/or drawing in of the jib hoist cable and the main boom hoist cables in dependence of one another, e.g. in a (pre)determined constant or dynamic ratio. In a further development thereof the method comprises, by operating the hoist winch(es), hoisting and/or lowering the object in between a lower position and a position at a height up to the height of the main boom departure sheaves by paying out and/or drawing in of the jib hoist cable and the main boom hoist cables separately and/or independently of one another, e.g. to separately and/or independently control horizontal and vertical movement components of the object.

In an embodiment the method comprises, by operating the hoist winch(es), the positioning of the object in a position with, and/or hoist and/or lower the object along a trajectory with, a smaller horizontal distance to the first pivot axis than the horizontal distance between the departure sheave and the first pivot axis.

In another embodiment the object is hoisted and/or lowered along a trajectory with a smaller horizontal distance to the first pivot axis than the horizontal distance between the departure sheave and the first pivot axis, wherein the trajectory is a straight vertical line.

In still another embodiment the method comprises the operation of the hoist winches, e.g. the one or two main boom hoist winches and the jib hoist winch, such as to hoist and/or lower the object while the angle of the jib hoist cable with respect to the plane defined by the main boom hoist cables remains constant. Therein, the jib may remain at the same angle with the main boom member during said hoisting and/or lowering of the object.

In an embodiment the main boom hoist assembly comprises two main boom hoist winches from each of which a respective one of the two main boom hoist cables extends. Therein the method comprises an operation of the main boom hoist winches such as to have a different length of main boom hoist cable unwounded, so to position the object in a position which, and/or hoist and/or lower the position along a trajectory which, in a top view of the crane, at least partly, extends laterally of the jib.

In a particular embodiment of the method, the object is suspended underneath the middle of the jib, that is, the middle of the jib in the length direction thereof, e.g. wherein the jib is in a substantially horizontal position. With the jib maintained at the same angle with the main boom member, e.g. in a substantially horizontal position, the object can then be hoisted or lowered over substantially a straight vertical line, between a lower position and a position up to substantially the height of main boom departure sheaves, e.g. up to a height just below the main boom departure sheaves. Therein the bending moment caused by the weight of the object around the first pivot axis is lower than the bending moment the crane is subjected to with a crane wherein the object is suspended substantially underneath the departure sheave and hoisted and/or lowered by the jib hoist assembly only. When therein, particularly, the main boom is in a substantially vertical position, the bending moment around the first pivot axis is half of the bending moment the crane is subjected to with a crane wherein the object is suspended substantially below the departure sheave and hoisted up or lowered by the jib hoist assembly only.

In a particular embodiment of the method, with the object suspended at substantially the height of main boom departure sheaves underneath the middle of the jib at substantially the height of the main boom departure sheaves, the jib may be luffed upwards to lift the object to a height above the main boom departure sheaves, so that the weight of the object is transferred from the main boom hoist cables and the jib hoist cable to the jib hoist cable on its own while the main boom hoist assembly may be used to control the horizontal movement, position and/or orientation of the object. This may e.g. be done while paying out the main boom hoist cables at a rate such that the object maintains the same horizontal distance to the first pivot axis so that the bending moment on the crane remains constant. The object may, simultaneously or thereafter be hoisted, up to a height just below the departure sheave. The reverse operation so to establish lowering the object at heights above the main boom departure sheaves is also enabled by the inventive arrangement of the jib hoist cables and main boom departure sheaves. When therein, particularly, the main boom is in a substantially vertical position, the bending moment caused by the weight of the object around the first pivot axis is half of the bending moment the crane is subjected to with a crane wherein the object is suspended substantially below the departure sheave and hoisted up or lowered by the jib hoist assembly only.

According to a combination of these particular embodiments, a further embodiment envisages that the one or more hoist winches consist of one jib hoist winch and one or two main boom hoist winches, the jib hoist cable extending from the jib hoist winch, and the two main boom hoist cables from the one main boom hoist winch. The embodiment comprises the steps of:

a) suspending the object in a lower position underneath a center portion of the jib, e.g. underneath the middle of the jib, b) operating the one or two main boom hoist winches and the jib hoist winch such as to draw in the main boom hoist cable and the jib hoist cable at a ratio such that the object is hoisted along a substantially straight vertical line underneath a center portion of the jib, e.g. underneath the middle of the jib, from the lower position and a position up to substantially the height of main boom departure sheaves, e.g. up to a height just below the main boom departure sheaves, while maintaining the jib at the same angle with the main boom member, c) pivoting the jib upwards to lift the object to a height above the main boom departure sheaves, so that substantially the whole weight of the object is therein transferred from the main boom hoist cables and the jib hoist cable to the jib hoist cable only, wherein the one or two main boom hoist winches are operated such as to pay out the main boom hoist cables at a rate such that the object is hoisted in line with said substantially straight vertical line, and d) operating the jib hoist winch so as to hoist the object upwards in line with said straight vertical line, while optionally operating the main boom hoist winches to control the horizontal position and/or orientation of the object.

In this further embodiment, advantageously, the bending moment on the crane around the second pivot axis caused by the weight of the object remains constant during steps a), b), c), and d).

In the above embodiment, the jib may have a substantially horizontal position during steps a) and b). Furthermore, the main boom member may have a substantially vertical position during steps a), b), c) and d).

In an embodiment, the object suspension device is provided, preferably at its outer side surface above the connection of the object suspension device with the object, with cable connectors, preferably three cable connectors, to which each of the main boom hoist cables and the jib hoist cable are respectively connected or connectable. Therein the cable connectors are preferably provided at equal mutual angles around a central vertical axis of the object suspension device. The crane is furthermore provided with a control device.

In an embodiment the object suspension device is provided, preferably at its outer side surface above the connection of the object suspension device with the object, with cable connectors, preferably three cable connectors, to which each of the main boom hoist cables and the jib hoist cable are respectively connected or connectable. These cable connectors are preferably provided at equal mutual angles around a central vertical axis of the object suspension device. Therein the method comprises an adjustment, e.g. a corrective adjustment, of the angular position of the object in its horizontal plane by pivoting the cable connectors around their vertical pivot axes.

In an embodiment a lower part of the object suspension device connected to the object is rotated relative to an upper part of the object suspension device connected to the jib hoist cable and/or the main boom hoist cables, so that the object is rotated around the central vertical axis of the object suspension device. Therein, preferably, the rotation of said lower part relative to said upper part is controlled by means of the control device, so that said rotation and thereby the angular position of the object in its horizontal plane is controlled thereby.

In an embodiment wherein the one or more hoist winches consist of one jib hoist winch and one or two main boom hoist winches, the jib hoist cable extending from the jib hoist winch, and the two main boom hoist cables from the one main boom hoist winch, the method comprises the steps of:

e1) paying out the main boom hoist cables until the object is substantially underneath the departure sheave, and substantially the whole weight of the object is supported by the jib hoist cable, and g1) hoisting and/or lowering the object by operating the jib hoist winch, wherein optionally the main boom hoist winches are operated to adjust the horizontal position and/or orientation of the object by the main boom hoist cables.

In another embodiment wherein the one or more hoist winches consist of one jib hoist winch and one or two main boom hoist winches, the jib hoist cable extending from the jib hoist winch, and the two main boom hoist cables from the one main boom hoist winch, the method comprises the steps of:

e2) paying out the jib hoist cable until the object is substantially underneath the main boom departure sheaves, and substantially the whole weight of the object is supported by the main boom hoist cables, g2) hoisting and/or lowering the object by operating the one or two main boom hoist winches, wherein optionally the jib hoist winch is operated to adjust the horizontal position and/or orientation of the object by the jib hoist cable.

In another embodiment, wherein the one or more hoist winches consist of one jib hoist winch and one or two main boom hoist winches, the jib hoist cable extending from the jib hoist winch, and the two main boom hoist cables from the one main boom hoist winch, and wherein furthermore the connection between the main boom hoist cables and the object and/or the object suspension device is releasable, and the main boom hoist cables and the jib hoist cable are connected to the object suspension device, the method comprises the steps of:

e3) paying out the main boom hoist cables until the object is substantially underneath the departure sheave, and substantially the whole weight of the object is supported by the jib hoist cable, f3) releasing the connection between the main boom hoist cables and the object and/or the object suspension device, g3) hoisting and/or lowering the object by operating the jib hoist winch, wherein optionally the main boom hoist winches are operated to adjust the horizontal position and/or orientation of the object by the main boom hoist cables.

In another embodiment wherein the one or more hoist winches consist of one jib hoist winch and one or two main boom hoist winches, the jib hoist cable extending from the jib hoist winch, and the two main boom hoist cables from the one main boom hoist winch, and wherein furthermore the connection between the jib hoist cable and the object and/or the object suspension device is releasable, and the main boom hoist cables and the jib hoist cable are connected to the object suspension device, the method comprises the steps of:

e4) paying out the jib hoist cable until the object is substantially underneath the main boom departure sheaves, and substantially the whole weight of the object is supported by the main boom hoist cables, f4) releasing the connection between the jib hoist cable and the object and/or the object suspension device, g4) hoisting and/or lowering the object by operating the one or two main boom hoist winches.

In an embodiment of the method, the object is hoisted and/or lowered while it is allowed to swing to an extent that is adjustable by the operation and/or operational settings of the one or more hoist winches and/or the main boom hoist heave compensation mechanism and/or the jib hoist heave compensation mechanism.

In an embodiment of the method, the object is hoisted and/or lowered while swinging is substantially not allowed by the operation and/or operational settings of the one or more hoist winches and/or the main boom hoist heave compensation mechanism and/or the jib hoist heave compensation mechanism.

In an embodiment of the method, the object being hoisted and/or lowered is a part of a wind turbine, e.g. a rotor blade, generator, or gearbox, and the method further comprises, prior to hoisting and/or lowering the wind turbine part, arranging the vessel with the wave-induced motion compensating crane in the vicinity of an offshore wind turbine, and the hoisting and/or lowering involves displacing the wind turbine part from the vessel to the wind turbine or vice versa.

The invention also relates to a method for positioning an object suspended from a wave-induced motion compensating crane that corresponds to the second and/or to the third aspect of the invention, e.g. on a floating vessel.

In an embodiment of the method using a crane according to the second aspect of the invention, the method comprises hoisting and/or lowering the object suspension device with an object connected thereto, by the three-point cable suspension mechanism, between a lower position and a position at a height up to just below the three departure sheaves while the three hoist cables together define a reverse pyramid diverging upwards in between the object suspension device and the three departure sheaves. This is done such that during this hoisting and/or lowering, any difference in cable tension between the three hoist cables is cancelled out by a movement of one or more of the interconnected guide sheaves towards or away from the adjacent departure sheaves.

This embodiment may further comprise operating the three hoist winches by the control device so as to simultaneously differently pay out and/or draw in the three hoist cables in reaction to, e.g. in dependence of, any difference in cable tension between the three hoist cables, thereby controlling movement of one or more of the interconnected guide sheaves towards or away from the adjacent departure sheaves so as to cancel out said difference in cable tension.

In an embodiment of the method using a crane according to the third aspect of the invention, the method comprising operating the two or three hoist winches by the control device such as to, synchronously, hoist and/or lower the object suspension device with an object connected thereto between a lower position and a position at a height up to substantially the height of the main boom departure sheaves while the jib hoist cable and the main boom hoist cables together define a reverse pyramid that diverges upwards from the object suspension device.

The following features of the inventive method using a crane according to the second and/or the third aspect have been described in relation to the method using a crane according to the first aspect of the invention. The specific explanation thereof as well as any effects and/or advantages thereof may be derived from the explanation in relation to the first aspect, and are therefore not repeated below.

The method may in embodiments comprise hoisting and/or lowering the object by operating the hoist winches in between a lower position and a position at a height up to the height of the lowermost of the departure sheaves by paying out and/or drawing in of the hoist cables in dependence of one another, e.g. in a (pre)determined constant or dynamic ratio.

The method may in embodiments comprise hoisting and/or lowering the object by operating the hoist winches in between a lower position and a position at a height up to the height of the lowermost of the departure sheaves by paying out and/or drawing in of the hoist cables separately and/or independently of one another, e.g. to separately and/or independently control horizontal and vertical movement components of the object.

The method may in embodiments comprise the positioning of the object in a position with, and/or the hoisting and/or lowering of the object along a trajectory with, a smaller horizontal distance to the first pivot axis than the horizontal distance between the departure sheave closest to the free end of the jib and the first pivot axis.

The method may in embodiments comprise hoisting and/or lowering of the object along a trajectory with a smaller horizontal distance to the first pivot axis than the horizontal distance between the departure sheave closest to the free end of the jib and the first pivot axis, wherein the trajectory is an straight vertical imaginary line.

The method may in embodiments comprise operating the one or more hoist winches such as to hoist and/or lower the object while the angle of the hoist cable most close to the free end of the jib with respect to the plane defined by the other two hoist cables remains constant.

In embodiments of the method, the jib may remains at the same angle with the main boom member during said hoisting and/or lowering of the object.

In embodiments of the method wherein each hoist cable extends from a different respective hoist winch, the method may comprise an operation of the hoist winches from which the hoist cables running via departure sheaves mounted at laterally opposite sides of the jib extend such as to each have a different length of hoist cable unwounded between the respective departure sheave and the object suspension device, so as to position the object in a position which, and/or hoist and/or lower the position along a trajectory which, in a top view of the crane, at least partly, extends laterally of the jib.

In embodiments of the method wherein the hoist cable(s) closest to the free end of the jib extend(s) from one or more hoist winches distinct from the one or more hoist winches from which the other hoist cable(s) extend(s), the method comprises the steps of:

a) suspending the object in a lower position underneath a center portion of the jib, e.g. underneath the middle of the jib,
b) operating the hoist winch(es) such as to draw in the hoist cable(s) at a ratio such that the object is hoisted along a substantially straight vertical imaginary line underneath the center portion of the jib, e.g. underneath the middle of the jib, from the lower position and a position at a height up to substantially the height of the lowermost of the departure sheaves, e.g. up to a height just below the lowermost of the departure sheaves, while maintaining the jib at the same angle with the main boom member,
c) pivoting the jib upwards to lift the object to a height above the lowermost of the departure sheaves, so that substantially the whole weight of the object is therein transferred from the three hoist cables together to the hoist cable(s) closest to the free end of the jib only, wherein the hoist winches from which the cable(s) closest to the second pivot axis extend(s) is/are operated such as to pay out the hoist cables at a rate such that the object is hoisted in line with said substantially straight vertical imaginary line, and
d) operating the hoist winch from which the hoist cable closest to the free end of the jib extends so as to hoist the object upwards in line with said straight vertical imaginary line, while optionally operating the hoist winches from which the cable(s) closest to the first pivot axis extend(s) such as to control the horizontal position and/or orientation of the object.

Therein, the bending moment on the crane around the second pivot axis caused by the weight of the object remains constant during steps a), b), c), and d).

The jib may have a substantially horizontal position during steps a) and b).

Furthermore, the main boom member may have a substantially vertical position during steps a), b), c) and d).

In embodiments of the method wherein the object suspension device is provided, preferably at its outer side surface above the connection of the object suspension device with the object, with cable connectors, preferably three cable connectors, to each of which the hoist cables are respectively connected, preferably provided at equal mutual angles around a central vertical axis of the object suspension device, the method comprising adjusting, e.g. a correctively adjusting, the angular position of the object in its horizontal plane by pivoting the cable connectors around their vertical pivot axes.

In an embodiment of the method, the method comprises rotating a lower part of the object suspension device connected to the object relative to an upper part of the object suspension device connected to the hoist cables, so as to rotate the object around the central vertical axis of the object suspension device. Therein preferably the rotating of said lower part relative to said upper part is controlled by means of the control device, if present, so that said rotating and thereby the actual angular position of the object in its horizontal plane is controlled thereby.

In embodiments of the method wherein the hoist cable(s) closest to the free end of the jib extend(s) from one or more hoist winches distinct from the one or more hoist winches from which the other hoist cable(s) extend(s), the method comprising the steps of:

e1) paying out the hoist cable(s) closest to the second pivot axis until the object is substantially underneath the departure sheave closest to the free end of the jib, and substantially the whole weight of the object is supported by the hoist cable(s) closest to the free end of the jib, g1) hoisting and/or lowering the object by operating the hoist winch from which the hoist cable(s) closest to the free end of the jib extends, wherein optionally the other hoist winch(es) is/are operated to adjust the horizontal position and/or orientation of the object by the hoist cables closest to the second pivot axis.

In other embodiments of the method wherein the hoist cable(s) closest to the free end of the jib extend(s) from one or more hoist winches distinct from the one or more hoist winches from which the other hoist cable(s) extend(s), the method comprises the steps of:

e2) paying out the hoist cable(s) closest to the free end of the jib until the object is substantially underneath the departure sheave(s) closest to the second pivot axis, and substantially the whole weight of the object is supported by the hoist cables closest to the second pivot axis, g2) hoisting and/or lowering the object by operating the hoist winch(es) from which the cable(s) closest to the second pivot axis extend(s), wherein optionally the hoist winch from which the hoist cable(s) closest to the free end of the jib is/are operated to adjust the horizontal position and/or orientation of the object by the hoist cable closest to the free end of the jib.

In embodiments of the method wherein the hoist cable(s) closest to the free end of the jib extend(s) from one or more hoist winches distinct from the one or more hoist winches from which the other hoist cable(s) extend(s), and wherein furthermore the connection between at least the hoist cable(s) closest to the second pivot axis and the object and/or the object suspension device is/are releasable, and the hoist cables are connected to the object suspension device, the method comprises the steps of:

e3) paying out the hoist cable(s) closest to the second pivot axis until the object is substantially underneath the departure sheave(s) closest to the free end of the jib, and substantially the whole weight of the object is supported by the hoist cable(s), closest to the free end of the jib, f3) releasing the connection between the hoist cable(s) closest to the second pivot axis and the object and/or the object suspension device, g3) hoisting and/or lowering the object by operating the hoist winch from which the hoist cable(s) closest to the free end of the jib extends, wherein optionally the other hoist winch(es) are operated to adjust the horizontal position and/or orientation of the object by the hoist cable(s) closest to the second pivot axis.

In other embodiments of the method wherein the hoist cable(s) closest to the free end of the jib extend(s) from one or more hoist winches distinct from the one or more hoist winches from which the other hoist cable(s) extend(s), and wherein furthermore the connection between at least the hoist cable(s) closest to the second pivot axis and the object and/or the object suspension device is/are releasable, and the hoist cables are connected to the object suspension device, the method comprises the steps of:

e4) paying out the hoist cable(s) closest to the free end of the jib until the object is substantially underneath the departure sheave(s) closest to the second pivot axis, and substantially the whole weight of the object is supported by the hoist cable(s) closest to the second pivot axis, f4) releasing the connection between the hoist cable(s) closest to the free end of the jib and the object and/or the object suspension device, g4) hoisting and/or lowering the object by operating the hoist winch(es) from which the cable(s) closest to the second pivot axis extend(s). Therein optionally the other hoist winch(es) are operated to adjust the horizontal position and/or orientation of the object by the hoist cable(s) closest to the free end of the jib.

In embodiments of the method the object is hoisted and/or lowered while it is allowed to swing to an extent that is adjustable by the operation and/or operational settings of the winch(es) and/or the heave compensation mechanism(s).

In embodiments of the method the object is hoisted and/or lowered while swinging is substantially not allowed by the operation and/or operational settings of the hoist winch(es) and/or the heave compensation mechanism(s).

In embodiments of the method the object being hoisted and/or lowered is a part of a wind turbine, e.g. a nacelle, a rotor blade, generator, or gearbox, and the method further comprises, prior to hoisting and/or lowering the wind turbine part, arranging the vessel with the wave-induced motion compensating crane in the vicinity of an offshore wind turbine, and the hoisting and/or lowering involves displacing the wind turbine part from the vessel to the wind turbine or vice versa.

The invention further relates to a vessel provided with a crane according to the first, second, and/or third aspect of the invention.

In embodiments of the method according to the invention use is made of this vessel. Therein the method may comprise the steps of:

m) suspending the wind turbine part in a position on, or near to, a deck of the vessel and underneath the jib, e.g. a center portion of the jib, e.g. underneath the middle of the jib, n) hoisting the wind turbine part with a high upwards velocity from the position or near to, the deck of the vessel to an intermediate position while the wind turbine part is allowed to swing to an extent that is adjustable by the operation and/or operational settings of the one or more hoist winches and/or the heave compensation mechanism(s), o) displacing the wind turbine part with a low upwards velocity from the intermediate position to, or near to, an installation position on or in a hub or a nacelle of the wind turbine, while swinging of the wind turbine part is substantially not allowed by the operation and/or operational settings of the one or more hoist winches and/or the heave compensation mechanism(s), p) installing the wind turbine part on or in the wind turbine, so that it is supported by the hub or the nacelle of the wind turbine.

Herein, in or near to the installation position of the wind turbine part, e.g. a root of the turbine blade is substantially aligned with a blade bearing on a hub of the wind turbine, or, e.g., the generator or gearbox is substantially aligned with a transfer opening within the top of the nacelle cover, or even on or above a floor on which it is to be supported.

In an embodiment of the method, wherein use is made of a vessel according to the invention, the method comprises the steps of:

q) suspending the wind turbine part in or near an installation position on or in a hub or a nacelle of the wind turbine, and underneath the jib, r) displacing the wind turbine part with a low downwards velocity from a position on or in a hub or a nacelle of the wind turbine to an intermediate position while swinging is substantially not allowed by the operation and/or operational settings of the one or more hoist winches and/or the main boom hoist heave compensation mechanism and/or the jib hoist heave compensation mechanism, s) lowering the wind turbine part with a low downwards velocity from the intermediate position to, or near to, the deck of the vessel, while the wind turbine part is allowed to swing to an extent that is adjustable by the operation and/or operational settings of the one or more hoist winches and/or the heave compensation mechanism(s), t) placing the wind turbine part on, or near to, a deck of the vessel or in the wind turbine, so that it is supported by the vessel.

The invention will now be described with reference to the drawings.

DETAILED DESCRIPTION OF EMBODIMENTS

Figure 1:
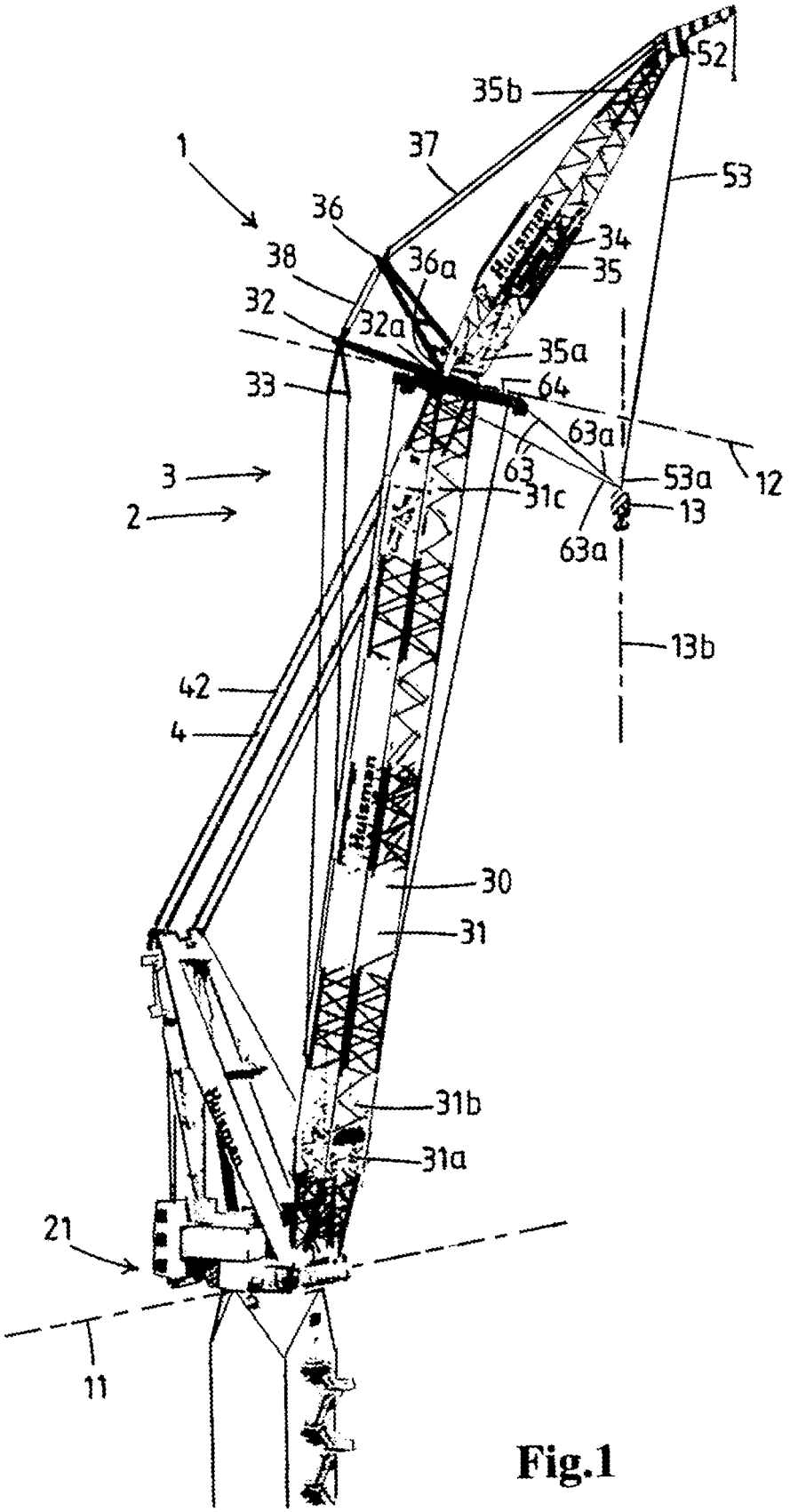
FIG. 1 shows a first embodiment of a crane according to the invention.

FIG. 1 shows an embodiment of a wave-induced motion compensating crane according to the invention in perspective view.

The crane comprises a revolving superstructure 2. It further comprises a boom 3 pivotally mounted to the revolving superstructure 2, e.g. to a foot portion 21 thereof.

The boom comprises a main boom 30, comprising firstly a main boom member 31, the lower end 31*a* of which is pivotally mounted about a first pivot axis 11 to the superstructure 2. It secondly comprises a main boom strut 32, an end 32*a* of which is mounted to an upper end of the main boom member 31 and extending essentially perpendicular to the main boom member 31. It thirdly comprises a boom stay 33 extending between the main boom strut 32 and a lower portion 31*b* of the main boom member 31.

The boom further comprises a jib 34, pivotally mounted about a second pivot axis 12 to the main boom 30. The jib comprises firstly a jib member 35, an inner end 35*a* of which is pivotally mounted to the upper end of the main boom member. It secondly comprises a jib strut 36 an end 36*a* of which is mounted to the inner end 35*a* of the jib member 35 and extending essentially perpendicular to the jib member 35. It thirdly comprises a jib stay 37 extending between the jib strut 35 and the jib member 36.

The boom further comprises a variable length stay mechanism 38 provided between the main boom strut 32 and the jib strut 36.

The crane further comprises a luffing assembly 4 comprising a luffing winch, mounted to the superstructure 2, and a luffing cable 42, extending between the luffing winch and the main boom 30.

The crane further comprises an object suspension device 13, to which an object is connected or connectable underneath the object suspension device 13.

Figure 3:
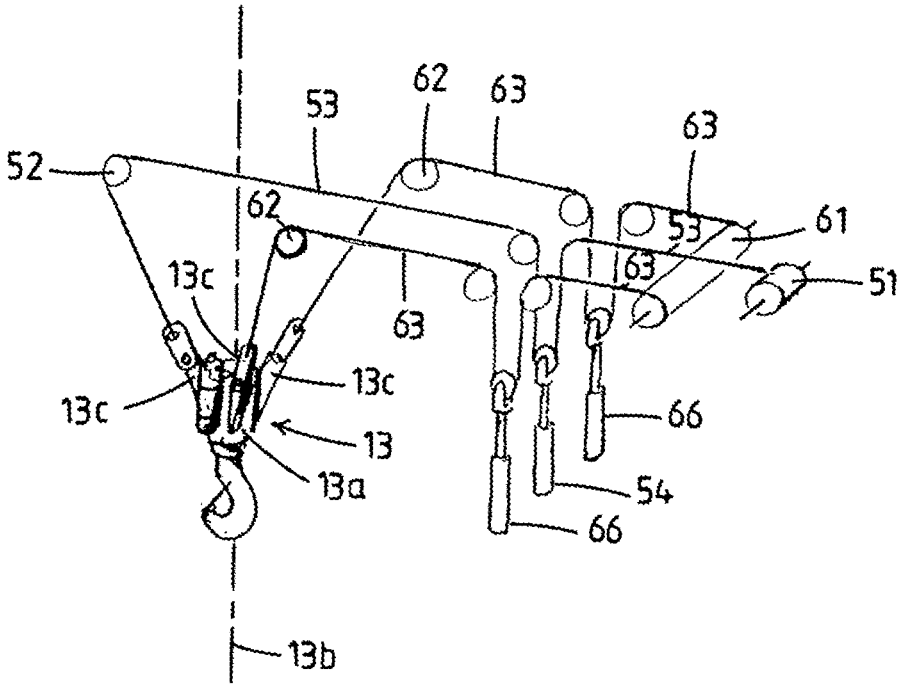
FIG. 3 schematically shows a possible arrangement of the hoist assembly of a crane according to the invention, FIGS. 4A-H schematically show a crane according to the invention in different possible working positions.

As shown in FIGS. 1 and 3, the crane further comprises a jib hoist assembly 5, which firstly comprises a jib hoist winch 51 and secondly a jib departure sheave 52, e.g. mounted on the free end of the jib member 35. It thirdly comprises a jib hoist cable 53, extending from the jib hoist winch 51 along the main boom 30 and the jib 34 via the jib departure sheave 52 to the object suspension device 13. It fourthly comprises a jib hoist heave compensation mechanism 66. Therein, the jib hoist heave compensation mechanism 54 comprises heave compensating cylinders operating on the unwound section of the jib hoist cable 5. In alternative, not shown embodiments, the one or two main boom hoist winches are embodied as AHC winches.

The crane further comprises a main boom hoist assembly 6, comprising, firstly one or two main boom hoist winches 61, secondly two main boom departure sheaves 62. It thirdly comprises two main boom hoist cables 63, configured to extend from either of the one or two main boom hoist winches along the main boom member 31 via the main boom departure sheaves 62 to the object suspension device 13. It fourthly comprises a main boom hoist heave compensation mechanism 66, wherein the main boom hoist heave compensation mechanism comprises heave compensating cylinders operating on the unwound section of the main boom hoist cable 63.

Figure 4A:
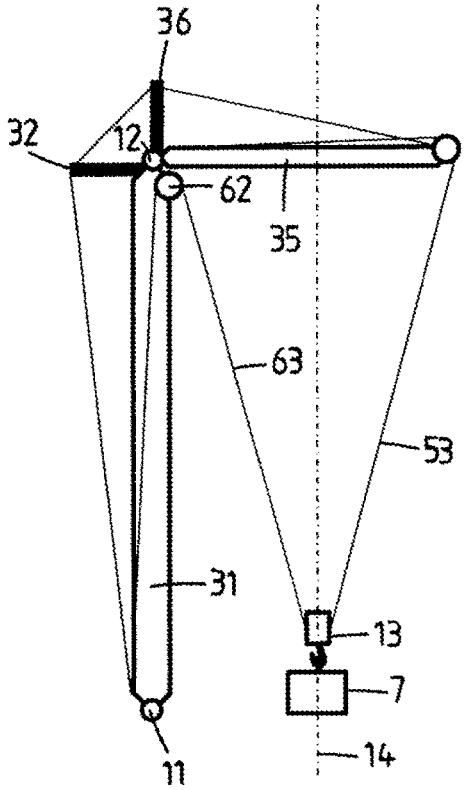
Figure 4B:
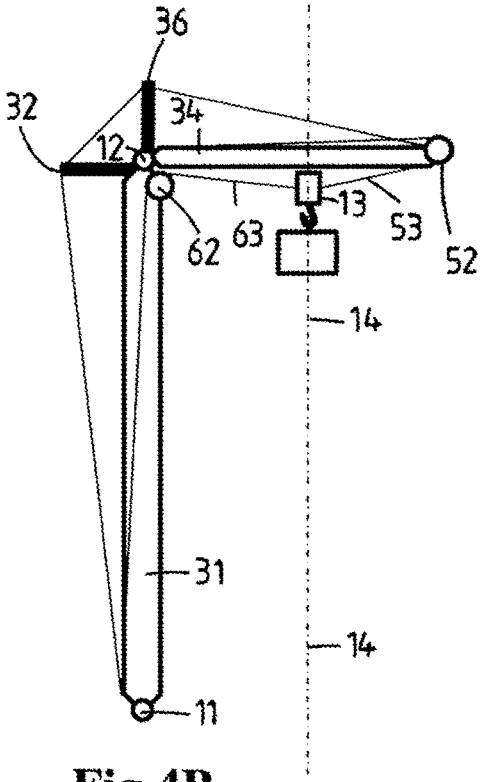
Figure 4C:
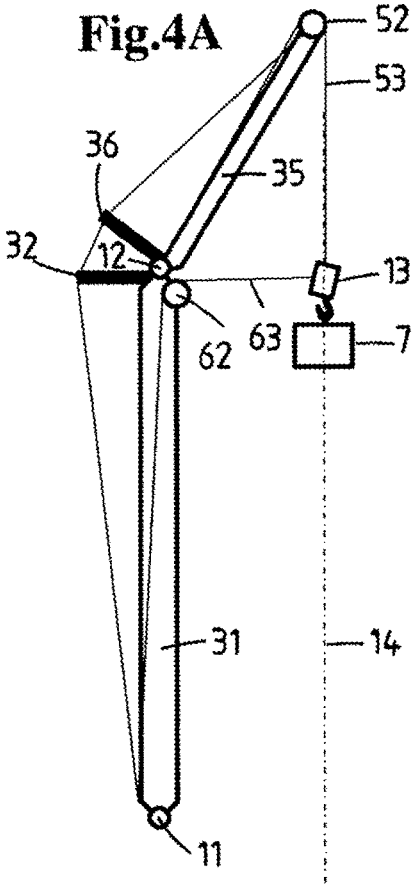
Figure 4D:
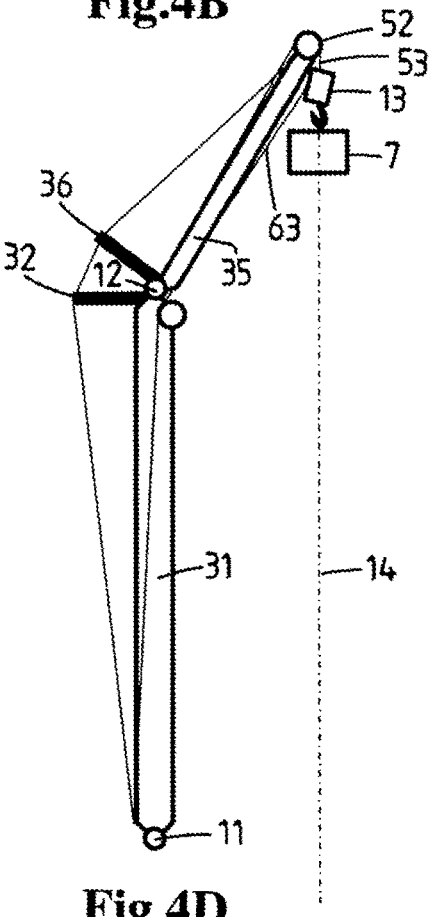
Figure 4E:
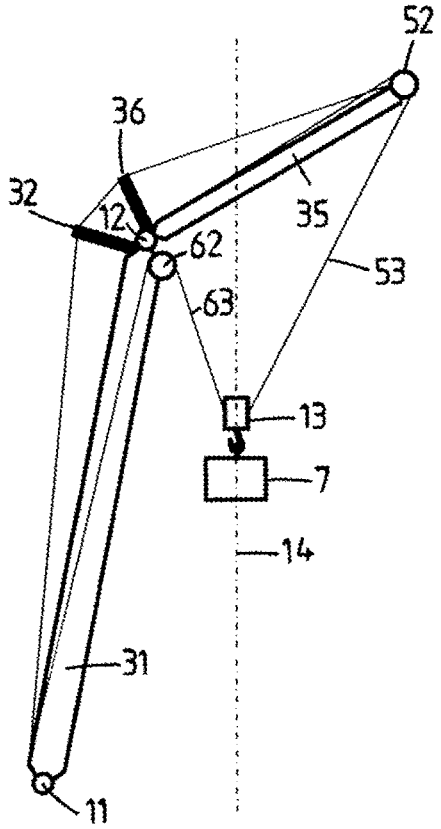
Figure 4F:
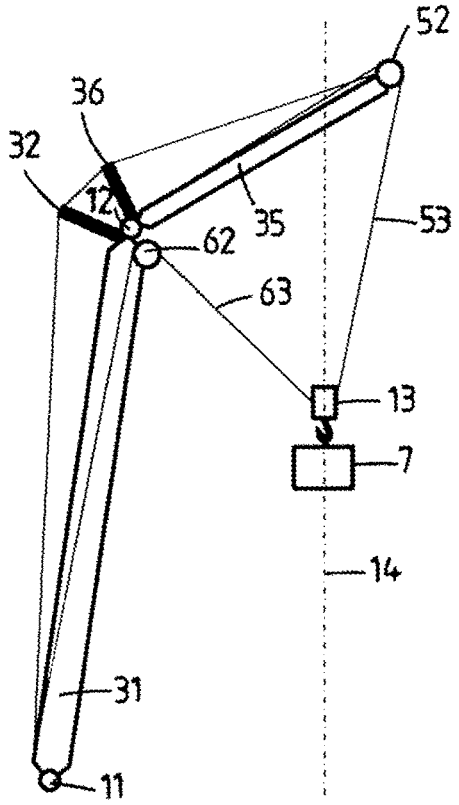
Figure 4G:
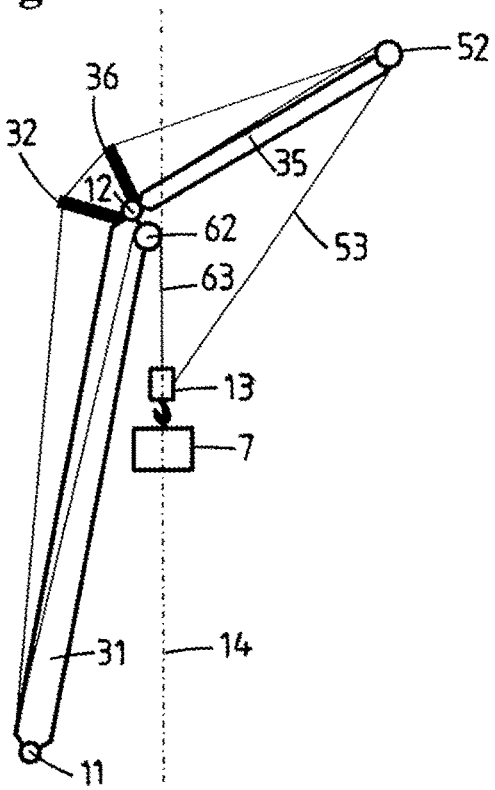
Figure 4H:
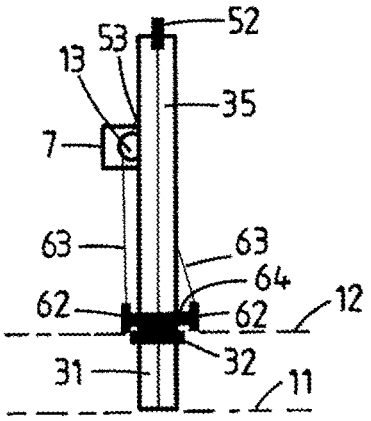

As shown in FIG. 1, and schematically in FIG. 4H, the two main boom departure sheaves 62 of the crane 1 are mounted to an upper end 31*c* of the main boom member 31 at opposite lateral sides thereof.

The object suspension device 13 is supported by the jib hoist cable 53 and the two main boom hoist cables 63, as visible from FIGS. 1 and 3 and FIGS. 4A-H.

As most clearly visible from FIG. 1, the main boom hoist assembly 6 is adapted to, together with the jib hoist assembly 5 hoist and/or lower the object suspension device 13 with an object 7 connected thereto, between a lower position and a position at a height up to substantially the height of the main boom departure sheaves 62 while the jib hoist cables 53 and the main boom hoist cables 63 together define a reverse pyramid diverging upwards from the object suspension device 13.

Figure 2:
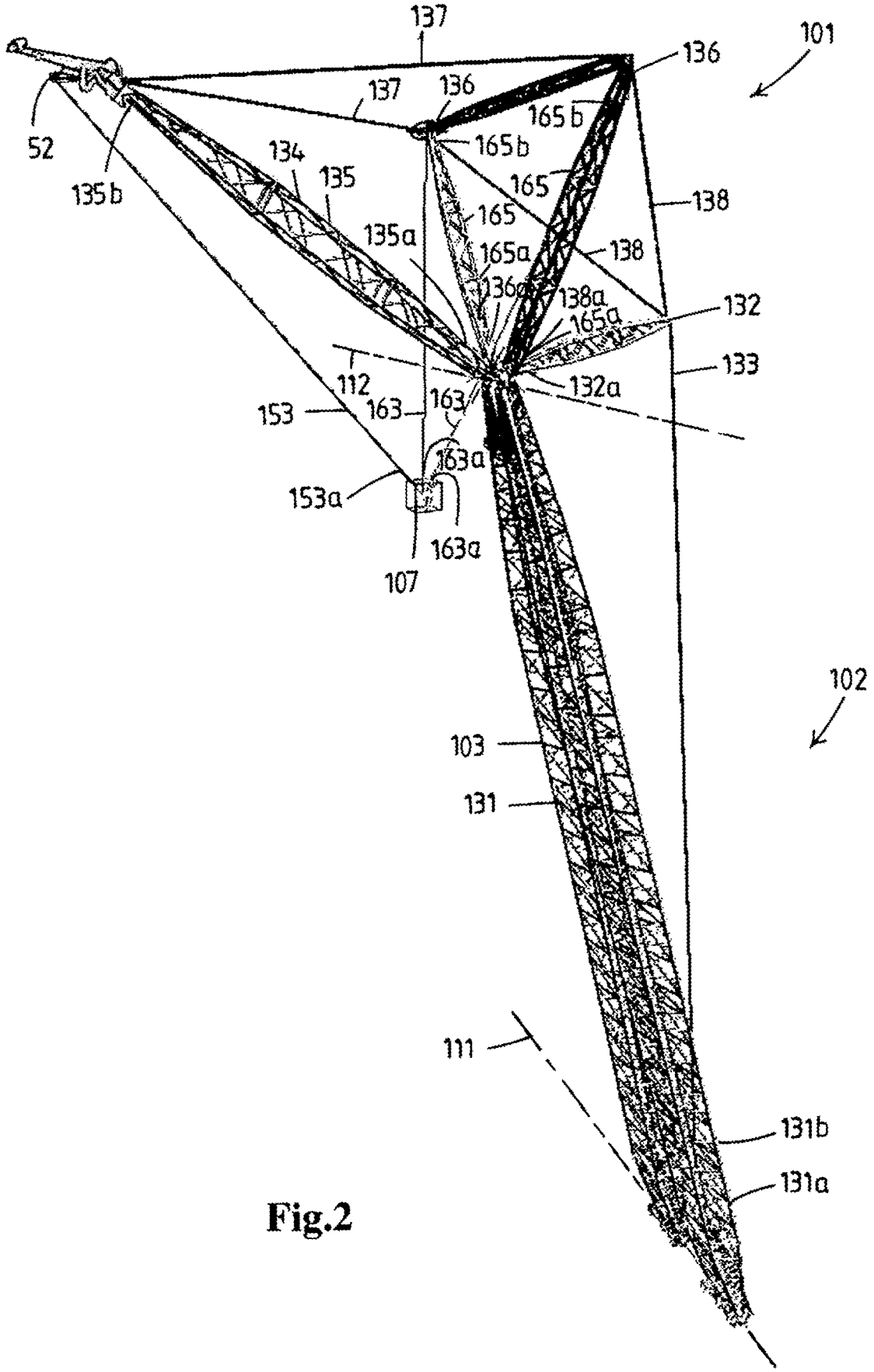
FIG. 2 shows a second embodiment of a crane according to the invention.

FIG. 2 shows a second embodiment of the crane according to the invention. The features discussed up to now for the embodiment shown in FIG. 1, are present as well in this embodiment shown in FIG. 2, wherein the reference numerals thereof correspond to those of the first embodiment, increased by 100.

Correspondingly, the arrangement of the jib hoist assembly 5 and the main boom hoist assembly 6 shown in FIG. 3, is applicable to the second embodiment as well. The same applies to the object suspension device shown in FIG. 5.

The crane 1 according to the first embodiment, shown in FIG. 1, has its main boom departure sheaves 62 mounted to lateral ends of a transverse beam 64, which transverse beam 64 is at a center portion thereof mounted to the upper end 31*c* of the main boom member 31.

The crane 101 according to the second embodiment, shown in FIG. 2, comprises two boom extensions 165, each having a lower end 165*a* thereof connected to the upper end 131*c* of the main boom member 131. The boom extensions 165 extend from the upper end 131*c* at equal upward angles relative to the horizontal and diverging from each other and from the jib 134 when seen in a top view of the crane 101. Therein each of the main boom departure sheaves 162 are mounted to a respective upper end 165*b* of the boom extensions 165.

Figure 5:
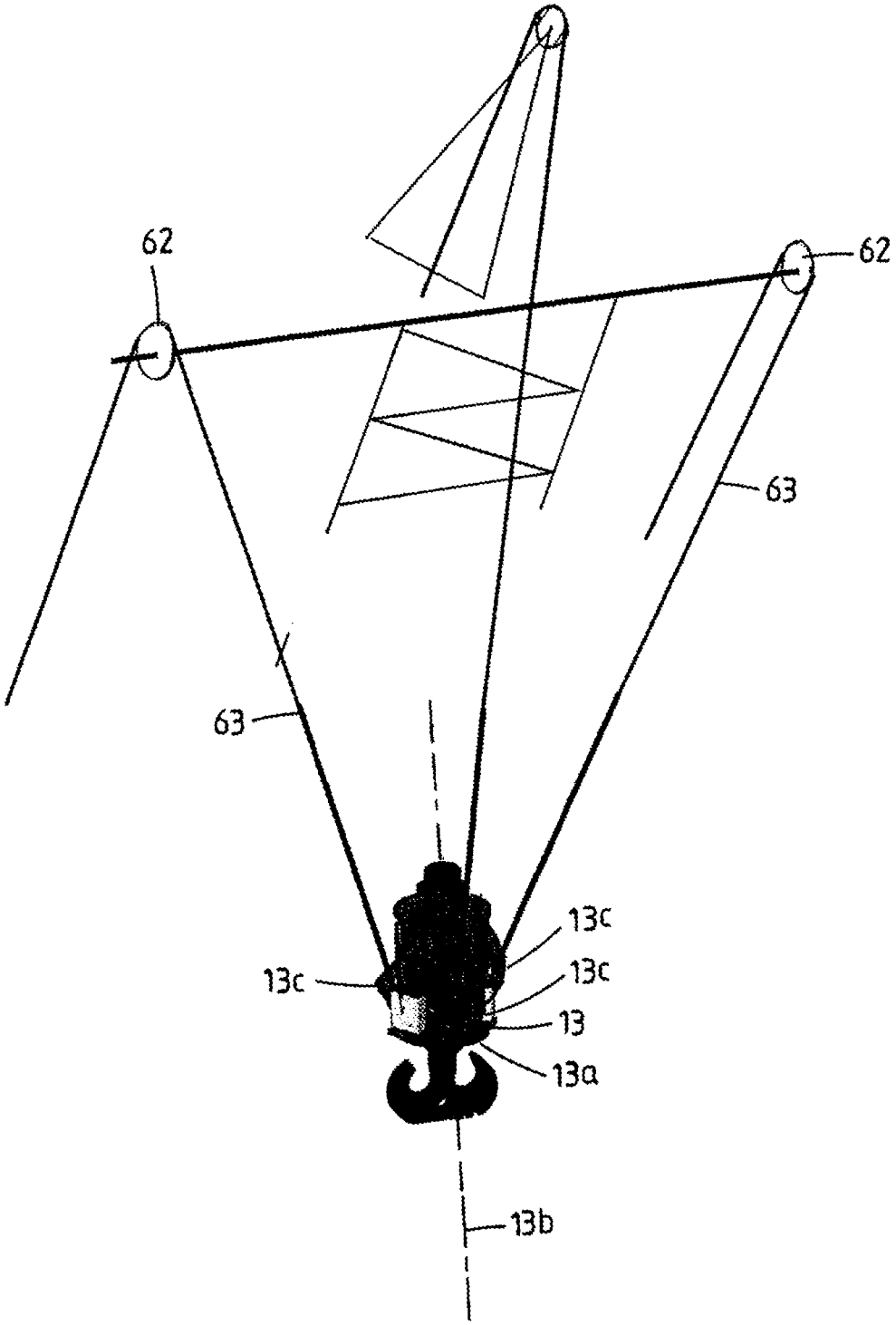
FIG. 5 shows an object suspension device according to either embodiment.

As shown in FIG. 3 and FIG. 5, in embodiments the object suspension device 13 is provided, preferably at its outer side surface 13*a* above the connection of the object suspension device 13 with the object 7, with cable connectors 13*c*, namely with three cable connectors 13*c*, to which each of the main boom hoist cables 63 and the jib hoist cable 53 are respectively connected or connectable. As is preferred, these are herein provided at equal mutual angles around a central vertical axis 13*b* of the object suspension device 13. The cable connectors 13*c* are pivotable around a respective vertical pivot axis 13*b*.

A lower part of the object suspension device 13 connected to the object 7 is rotatable relative to an upper part of the object suspension device 13 connected to the jib hoist cable and/or the main boom hoist cables, so that the object 7 is rotatable around the central vertical axis 13*b* of the object suspension device 13, wherein preferably the rotation of said lower part relative to said upper part is controllable by means of the control device, so that the angular position of the object 7 in its horizontal plane is controllable thereby.

Not shown in the figures is that the crane is furthermore provided with a control device, programmed to operate the variable length stay mechanism and the luffing assembly automatically.

Therein the control device is programmed to operate the one or two main boom hoist winches and jib hoist winch, so as to control the position of the object by simultaneously paying out and/or drawing in of the jib hoist cable and the main boom hoist cables in dependence of one another.

Therein the control device is furthermore programmed to operate the one or two main boom hoist winches and the jib hoist winch based on a predetermined trajectory and/or one or more reference positions of the object.

Therein the control device is furthermore programmed to operate the main boom hoist winches and jib hoist winch in dependence of the vertical and/or horizontal position and/or motions of the object.

Therein the control device is furthermore programmed to operate the main boom hoist winches and jib hoist winch by feedback control and/or feedforward control based on live measurements by sensors providing actual data on the position and/or orientation and/or motions of the object and/or the jib hoist cable and/or the main boom hoist cables to the control device.

Therein the control device is furthermore programmed to operate the main boom hoist winches and jib hoist winch independently.

In the embodiment shown in FIG. 3 the main boom hoist assembly 6 comprises one main boom hoist winch 61, from which both of the two main boom hoist cables 63 extend.

In embodiments other than that shown in FIG. 3 wherein furthermore the control device is provided, and the main boom hoist assembly comprises two main boom hoist winches 61, from each of which a respective one of the two main boom hoist cables 63 extends, the control device is programmed to operate each of the main boom hoist winches 61 separately.

In the shown embodiments the connection between the jib hoist cable and the object and/or the object suspension device and/or the connection between the jib hoist cable and the object and/or the object suspension device is releasable.

Furthermore the main boom hoist cables and/or jib hoist cable are connected to the object suspension device with respective terminal ends, in the first embodiment terminal ends 53*a* and 63*a*, and in the second embodiment terminal ends 153*a* and 163*a* thereof.

It is remarked at this point that even though only the crane according to the first aspect of the invention has been explained in relation to FIGS. 1-5, the illustration of the features apply similarly to a crane according to the second and/or third aspect, even as the explanation thereof and any mentioned effects and/or advantages thereof.

Figure 6:
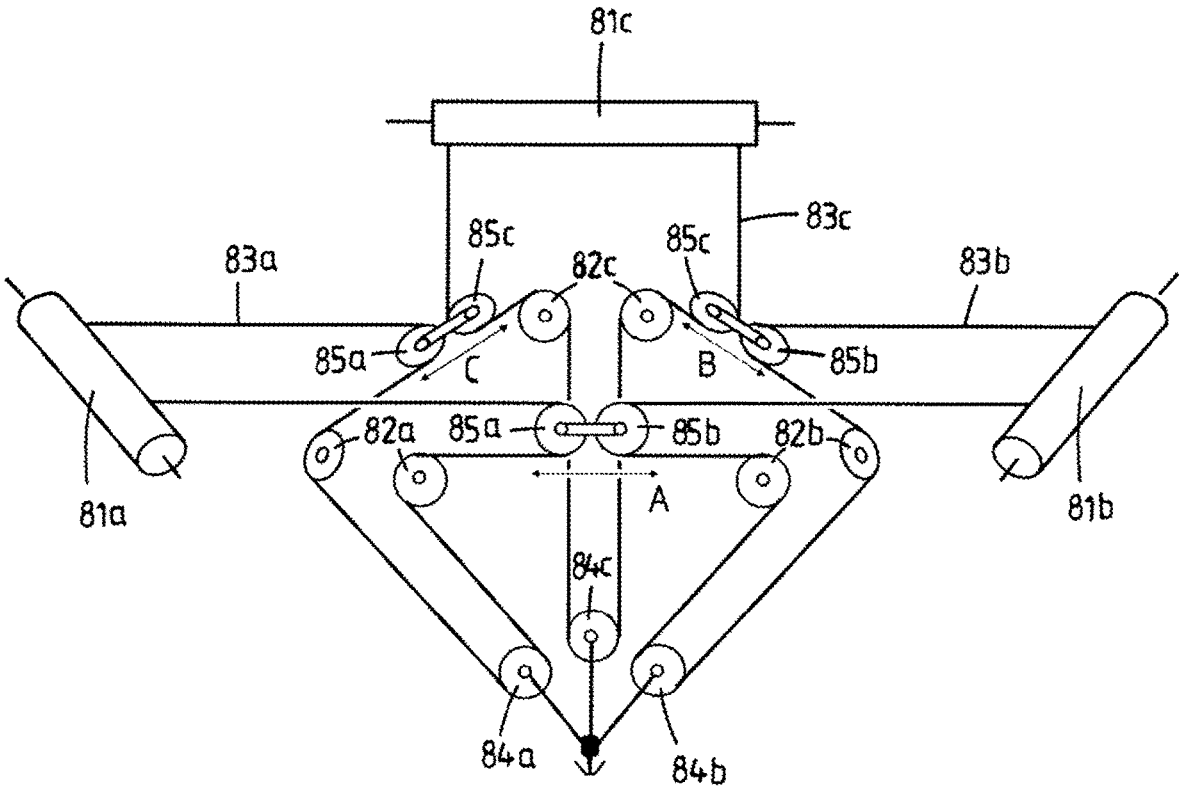
FIG. 6 schematically shows the three-point cable suspension mechanism of a crane according to the second aspect of the invention.

FIG. 6 shows, in a schematic way, the three-point cable suspension mechanism of a crane according to the second aspect of the invention.

This three-point cable suspension mechanism comprises, firstly, three hoisting systems. Each hoisting system comprising a hoist winch 81*a*, 81*b*, 81*c*, two departure sheaves 82*a*, 82*b*, 82*c*, a hoist cable 83*a*, 83*b*, 83*c*, a spreader sheave 84*a*, 84*b*, 84*c*, and two mobile guide sheaves 85*a*, 85*b*, 85*c*.

The three-point cable suspension mechanism comprises secondly a heave compensation mechanism, e.g. wherein one or more of the hoist winches of the hoisting systems are embodied as an AHC winch, or wherein the hoist assembly comprises heave compensating cylinders operating on the unwound section of the hoist cables of the hoisting systems. This heave compensation mechanism is not shown in FIG. 6.

It may be derived that the hoisting cable 83*a*, 83*b*, 83*c* of each hoisting system extends from the hoist winch thereof, successively via one of the two mobile guide sheaves thereof, one of the departure sheaves thereof, the spreader sheave thereof, the other one of the two departure sheaves thereof, and the other one of the two mobile guide sheaves thereof to the hoist winch thereof.

Each of the two mobile guide sheaves 85*a*, 85*b*, 85*c* of each hoisting system being interconnected to a mobile guide sheave of the two other hoisting systems such that its rotational axis is parallel to that of the mobile guide sheave connected thereto, and being mounted to the crane such as to be movable with respect thereto in a direction A, B, C perpendicular to its rotational axis, and towards or away from an adjacent departure sheave of its hoisting system.

It is not shown in FIG. 6 that the departure sheaves 82*a*, 82*b*, 82*c* are mounted to an upper part of the crane, e.g. the jib and/or an upper end of the main boom, such as to have at least two of the three departure sheaves positioned at opposite lateral sides from the jib, so that the departure sheaves and the mobile guide sheaves define a triangle when seen in a top view of the crane.

The spreader sheaves 84*a*, 84*b*, 84*c* are each connected to the object suspension device and therein radially surround the object suspension device.

The three-point cable suspension mechanism is adapted to hoist and/or lower the object suspension device with an object connected thereto between a lower position and a position at a height up to just below the three departure sheaves 82*a*, 82*b*, 82*c* while the three hoist cables 83*a*, 83*b*, 83*c* together define a reverse pyramid diverging upwards in between the object suspension device and the three departure sheaves, This is done such that any difference in cable tension between the three hoist cables results in a movement of one or more of the interconnected guide sheaves towards or away from the adjacent departure sheaves so as to cancel out said difference in cable tension.

A crane provided with this three-point cable suspension mechanism may furthermore be provided with a control device, programmed to operate the three hoist winches 81*a*, 81*b*, 81*c* so as to control the position and/or velocity of the object by simultaneously paying out and/or drawing in of the three hoist cables 83*a*, 83*b*, 83*c* in dependence of the vertical and/or horizontal position and/or motions of the object and/or the object suspension device and/or the vessel and/or the crane.

Therein the control device may furthermore be programmed to operate the three hoist winches 81*a*, 81*b*, 81*c* so as to simultaneously differently pay out and/or draw in the three hoist cables 83*a*, 83*b*, 83*c* in reaction to, e.g. in dependence of, any difference in cable tension between the three hoist cables, thereby controlling movement of one or more of the interconnected guide sheaves towards or away from the adjacent departure sheaves so as to cancel out said difference in cable tension.

It may be envisaged with the schematic of FIG. 6, e.g. in combination with FIG. 5, that one or more spreaders, e.g. three horizontal beams, may be provided in between the object suspension device and the spreader sheaves 84*a*, 84*b*, 84*c* so as to determine a radial distance between the central vertical axis 13*b*; 113*b* of the object suspension device 13; 113 and each spreader sheave.

In embodiments of a method according to the invention that makes use of a crane provided with this three-point cable suspension mechanism, during this hoisting and/or lowering, any difference in cable tension between the three hoist cables is cancelled out by a movement of one or more of the interconnected guide sheaves towards or away from the adjacent departure sheaves.

In embodiments of such a method the three hoist winches 81*a*, 81*b*, 81*c* may be operated by the control device so as to simultaneously differently pay out and/or draw in the three hoist cables 83*a*, 83*b*, 83*c* in reaction to, e.g. in dependence of, any difference in cable tension between the three hoist cables, thereby controlling movement of one or more of the interconnected guide sheaves towards or away from the adjacent departure sheaves so as to cancel out this difference in cable tension.

With regard to the following discussion of embodiments of a method according to the invention in relation to the figures, it is emphasized that even though the explanation relates to a method making use of the crane according to the first aspect of the invention in relation to FIGS. 1-5, the illustration of the features of the method applies similarly to a method making use of a crane according to the second and/or to the third aspect, even as the explanation thereof and any mentioned effects and/or advantages thereof.

The discussed embodiments of the crane are suitable for use in a method for positioning an object suspended therefrom. FIGS. 4A-H show the first embodiment in different working positions in a side view of the crane. It may be understood that these positions are attainable as well with other embodiments. For the second embodiment as discussed, the following discussion in referral to the figures is correspondingly applicable as well, with the reference numerals changed by 100.

The method comprises the operation of the main boom hoist assembly 6 and the jib hoist assembly 5 such as to, synchronously, hoist and/or lower the object suspension device 13 with an object 7 connected thereto between a lower position, e.g. as shown in FIG. 4A to a position at a height up to substantially the height of the main boom departure sheaves 62 as shown e.g. in FIG. 4B, while the jib hoist cable 53 and the main boom hoist cables 63 together define a reverse pyramid that diverges upwards from the object suspension device 13.

Therein the method may comprise paying out and/or drawing in of the jib hoist cable 53 and the main boom hoist cables 63 in dependence of one another, in hoisting and/or lowering the object 7 in between a lower position e.g. as shown in FIG. 4A and a position at a height up to the height of the main boom departure sheaves 62 e.g. as shown in FIG. 4B.

The advancement from FIG. 4A to FIG. 4D illustrate the method comprising the positioning of the object in a position with, and/or hoist and/or lower the object 7 along a trajectory with, a smaller horizontal distance to the first pivot axis 11 than the horizontal distance between the jib departure sheave 52 and the first pivot axis 11.

Respectively in alphabetic or reverse order these figures illustrate the object 7 being hoisted and lowered along a trajectory with a smaller horizontal distance to the first pivot axis 11 than the horizontal distance between the departure sheave 52 and the first pivot axis 11, wherein the trajectory is an straight vertical imaginary line 14.

FIG. 4E and 4F show two example positions of the imaginary straight vertical line 14 along which hoisting and/or lowering is possible according to embodiments. The position of FIG. 4E is closer to the main boom departure sheave 62 than to the departure sheave 52, and that of FIG. 4F is closer to the departure sheave 52 than to the main boom departure sheave.

Not illustrated is an embodiment in which the operation of the one or two main boom hoist winches and the jib hoist winch such as to hoist and/or lower the object 7 while the angle of the jib hoist cable with respect to the plane defined by the main boom hoist cables remains constant.

As illustrated by the advancement from FIG. 4A to 4B and from FIG. 4E to 4F, in an embodiment of the method the jib 34 remains at the same angle with the main boom member 31 during said hoisting and/or lowering of the object 7.

Not illustrated in the figures is an embodiment in which the main boom hoist assembly 6 comprises two main boom hoist winches 61 from each of which a respective one of the two main boom hoist cables 63 extends. In this embodiment the method comprises an operation of the main boom hoist winches 61 such as to have a different length of main boom hoist cable 63 unwounded, so to position the object 7 in a position which, and/or hoist and/or lower the position along a trajectory which, in a top view of the crane 1, at least partly, extends laterally of the jib 34.

A particular embodiment of the method is illustrated by the advancement from FIG. 4A to FIG. 4D. It comprises the following steps.

a) suspending the object 7 in a lower position underneath the middle of the jib 34, so as to arrive at the position shown in FIG. 4A, b) operating the one or two main boom hoist winches 61 and the jib hoist winch 51 such as to draw in the main boom hoist cable 63 and the jib hoist cable 63 at a ratio such that the object 7 is hoisted along a substantially straight vertical imaginary line 14 underneath the middle of the jib 34, from the lower position and a position up to substantially the height of main boom departure sheaves 62, e.g. up to a height just below the main boom departure sheaves 62, while maintaining the jib 34 at the same angle with the main boom member 31, so as to arrive at the position shown in FIG. 4B, c) pivoting the jib 34 upwards to lift the object 7 to a height above the main boom departure sheaves 62, so that substantially the whole weight of the object 7 is therein transferred from the main boom hoist cables 63 and the jib hoist cable 53 to the jib hoist cable 53 only, wherein the one or two main boom hoist winches 61 are operated such as to pay out the main boom hoist cables 63 at a rate such that the object 7 is hoisted in line with said substantially straight vertical imaginary line 14, so as to arrive at the position shown in FIG. 4C, and d) operating the jib hoist winch 61 so as to hoist the object 7 upwards in line with said straight vertical imaginary line 14, while optionally operating the main boom hoist winches 61 to control the horizontal position and/or orientation of the object 7, so as to arrive at the position shown in FIG. 4D.

Therein the bending moment on the crane 1 around the second pivot axis 12 caused by the weight of the object 7 remains constant during steps a, b, c, and d. In this embodiment, the jib 34 has a substantially horizontal position during steps a and b, and the main boom member has a substantially vertical position during steps a, b, c and d.

As illustrated in FIGS. 3 and 5, in an embodiment the object suspension device 13 is provided, preferably at its outer side surface above the connection of the object suspension device 13 with the object 7, with cable connectors 13*c*, namely three cable connectors 13*c*, to which each of the main boom hoist cables 63 and the jib hoist cable 53 are respectively connected. These are provided at equal mutual angles around the central vertical axis 13*b* of the object suspension device. Therein the method comprises an adjustment, e.g. a corrective adjustment, of the angular position of the object 7 in its horizontal plane by pivoting the cable connectors around their vertical pivot axes.

In a not illustrated embodiment a lower part of the object suspension device 13 connected to the object 7 is rotated relative to an upper part of the object suspension device 13 connected to the jib hoist cable 53 and/or the main boom hoist cables 63, so that the object 7 is rotated around the central vertical axis 13*b* of the object suspension device 13. Therein preferably the rotation of said lower part relative to said upper part is controlled by means of the control device, so that said rotation and thereby the angular position of the object 7 in its horizontal plane is controlled thereby.

A particular embodiment comprises the steps of:

e1) paying out the main boom hoist cables 63 until the object 7 is substantially underneath the departure sheave 52, and substantially the whole weight of the object 7 is supported by the jib hoist cable 53, e.g. to arrive at the position of FIG. 4C, and g1) hoisting and/or lowering the object 7 by operating the jib hoist winch 51, wherein optionally the main boom hoist winches 61 are operated to adjust the horizontal position and/or orientation of the object by the main boom hoist cables.

A particular embodiment comprises the steps of:

e2) paying out the jib hoist cable 53 until the object 7 is substantially underneath the main boom departure sheaves 62, and substantially the whole weight of the object 7 is supported by the main boom hoist cables 63, e.g. so as to arrive at the position of FIG. 4G, and g2) hoisting and/or lowering the object 7 by operating the one or two main boom hoist winches 61, wherein optionally the jib hoist winch 51 is operated to adjust the horizontal position and/or orientation of the object 7 by the jib hoist cable 53.

Not illustrated in the figures is an embodiment wherein the connection between the main boom hoist cables 63 and the object 7 and/or the object suspension device 13 is releasable, and the main boom hoist cables 63 and the jib hoist cable 53 are connected to the object suspension device 13. This embodiment comprises the steps of:

e3) paying out the main boom hoist cables 63 until the object 7 is substantially underneath the departure sheave 62, and substantially the whole weight of the object 7 is supported by the jib hoist cable 53, f3) releasing the connection between the main boom hoist cables 63 and the object 7 and/or the object suspension device 13, g3) hoisting and/or lowering the object 7 by operating the jib hoist winch 51, wherein optionally the main boom hoist winches 61 are operated to adjust the horizontal position and/or orientation of the object 7 by the main boom hoist cables.

Not illustrated in the figures is an embodiment wherein the connection between the jib hoist cable 53 and the object 7 and/or the object suspension device 13 is releasable, and the main boom hoist cables 63 and the jib hoist cable 53 are connected to the object suspension device 13. This embodiment comprises the steps of:

e4) paying out the jib hoist cable 53 until the object 7 is substantially underneath the main boom departure sheaves 62, and substantially the whole weight of the object 7 is supported by the main boom hoist cables 63, f4) releasing the connection between the jib hoist cable 53 and the object 7 and/or the object suspension device 13, g4) hoisting and/or lowering the object 7 by operating the one or two main boom hoist winches 61.

The invention claimed is:

1. A crane for use on a floating vessel, said crane comprising:

a revolving superstructure;

a boom pivotally mounted to the revolving superstructure, the boom comprising:

a main boom comprising a main boom member having a lower end pivotally mounted about a first pivot axis to the superstructure; and, a jib comprising a jib member having an inner end pivotally mounted about a second pivot axis to an upper end of the main boom member;

a luffing assembly configured for luffing of the main boom;

a jib angle adjustment mechanism configured to adjust a pivot angle of the jib relative to the main boom; and an object suspension device configured to be connected to an object underneath the object suspension device, wherein the crane comprises a hoisting system comprising:

one or more hoist winches;

a jib hoist assembly comprising:

a jib departure sheave mounted to the jib member;

a jib hoist cable configured to extend from said one or more hoist winches along the main boom and the jib via the jib departure sheave to the object suspension device; and a jib hoist heave compensation mechanism; and a main boom hoist assembly comprising:

two main boom departure sheaves mounted to the upper end of the main boom member at opposite lateral sides thereof;

two main boom hoist cables configured to extend from said one or more hoist winches along the main boom member via the main boom departure sheaves to the object suspension device; and a main boom hoist heave compensation mechanism, wherein the object suspension device is supported by the jib hoist cable and by the two main boom hoist cables, and wherein the main boom hoist assembly is adapted to, together with the jib hoist assembly, hoist and lower the object suspension device with an object connected thereto between a lower position and a position at a height up to substantially a height of the main boom departure sheaves while the jib hoist cables and the two main boom hoist cables together define a reverse pyramid diverging upwards from the object suspension device.

2. The crane according to claim 1, wherein the main boom departure sheaves are mounted to lateral ends of a transverse beam, the transverse beam being at a center portion thereof mounted to the upper end of the main boom member.

3. The crane according to claim 1, wherein the crane further comprises two boom extensions, each having a lower end thereof connected to the upper end of the main boom member, the boom extensions extending from said upper end at equal upward angles relative to horizontal and diverging from each other and from the jib when seen in a top view of the crane, wherein each of the main boom departure sheaves is mounted to a respective upper end of the boom extension.

4. The crane according to any of claim 1, wherein the one or more hoist winches consist of:

one jib hoist winch and one main boom hoist winch, the jib hoist cable extending from the one jib hoist winch, and two main boom hoist cables extending from the one main boom hoist winch, or one jib hoist winch and two main boom hoist winches, the jib hoist cable extending from the one jib hoist winch, and the two main boom hoist cables each extending from a respective one of the two main boom hoist winches.

5. The crane according to claim 1, wherein the jib of the crane further comprises:

a jib strut having an end mounted to the inner end of the jib member and extending essentially perpendicular to the jib member; and a jib stay extending between the jib strut and the jib member, wherein the main boom further comprises:

a main boom strut having an end mounted to an upper end of the main boom member and extending essentially perpendicular to the main boom member; and a boom stay extending between the main boom strut and a lower portion of the main boom member, wherein the boom further comprises a variable length stay mechanism provided between the main boom strut and the jib strut, wherein the luffing assembly of the crane further comprises:

a luffing winch mounted to the superstructure; and a luffing cable extending between the luffing winch and the main boom.

6. The crane according to claim 1, wherein the main boom hoist cables are each arranged in a double-fall arrangement, wherein the main boom hoist assembly comprises two pairs of main boom departure sheaves, each pair of main boom departure sheaves being mounted to the upper end of the main boom member at opposite lateral sides thereof, and further comprises two main boom spreader sheaves, each connected to the object suspension device, and wherein the main boom hoist cables are each configured to extend from one of said hoist winches along the main boom member successively via one main boom departure sheave of a respective pair of main boom departure sheaves, a respective one of the two main boom spreader sheaves, and the other main boom departure sheave of the respective pair of main boom departure sheaves to the one of the hoist winches, and wherein the jib hoist cable is arranged in a double-fall arrangement, wherein the jib hoist assembly comprises a pair of jib hoist sheaves, mounted to the jib member, and further comprises a jib spreader sheave, connected to the object suspension device, and wherein the jib hoist cable is configured to extend from one of the hoist winches along the main boom and the jib successively via one jib departure sheave of the pair of jib hoist sheaves, the jib spreader sheave, and the other jib departure sheave of the pair of jib hoist sheaves to the one of the hoist winches.

7. The crane according to claim 1, wherein the object suspension device is provided with three cable connectors to each of which a respective hoist cable is connected, the three cable connectors being provided at equal mutual angles around a central vertical axis of the object suspension device, wherein the cable connectors are each pivotal around a respective vertical pivot axis relative to the object suspension device.

8. The crane according to claim 1, wherein a lower part of the object suspension device is configured to be connected to the object and is rotatable relative to an upper part of the object suspension device that is connected to the hoist cables, so that the object is rotatable around a central vertical axis of the object suspension device, wherein the rotation of said lower part relative to said upper part is controllable by means of a control device, so that an angular position of the object in a horizontal plane is controllable thereby.

9. A wave-induced motion compensating crane provided with a three-point cable suspension mechanism, said crane being configured for use on a vessel, said crane comprising:

a boom comprising:

a main boom comprising a main boom member having a lower end pivotally mounted about a first pivot axis to a structure; and a jib comprising a jib member having an inner end pivotally mounted about a second pivot axis to an upper end of the main boom member;

a luffing assembly configured for luffing of the main boom;

a jib angle adjustment mechanism configured to adjust the pivot angle of the jib relative to the main boom; and an object suspension device configured to connect an object underneath the object suspension device, wherein the three-point cable suspension mechanism comprises:

three hoisting systems, each hoisting system comprising a hoist winch, two departure sheaves, a hoist cable, a spreader sheave, and two mobile guide sheaves; and a heave compensation mechanism, wherein the hoisting cable of each hoisting system extends from the hoist winch thereof, successively via one of the two mobile guide sheaves thereof, one of the departure sheaves thereof, the spreader sheave thereof, the other one of the two departure sheaves thereof, and the other one of the two mobile guide sheaves thereof to the hoist winch thereof, wherein each of the two mobile guide sheaves of each hoisting system is connected to a mobile guide sheave of the two other hoisting systems such that a rotational axis thereof is parallel to that of the mobile guide sheave connected thereto, and is mounted to the crane such as to be movable with respect thereto in a direction perpendicular to the rotational axis, and towards or away from an adjacent departure sheave of the respective hoisting system, wherein the departure sheaves are mounted to the jib and/or to the upper end of the main boom, such as to have at least two of the three departure sheaves positioned at opposite lateral sides from the jib, so that the departure sheaves and the mobile guide sheaves define a triangle when seen in a top view of the crane, and wherein the spreader sheaves are each connected to the object suspension device, the spreader sheaves radially surrounding the object suspension device, and wherein the three-point cable suspension mechanism is adapted to hoist and/or lower the object suspension device with an object connected thereto while the three hoist cables together define a reverse pyramid diverging upwards in between the object suspension device and the three departure sheaves, such that any difference in cable tension between the three hoist cables results in a movement of one or more of the interconnected guide sheaves towards or away from the adjacent departure sheaves so as to cancel out said difference in cable tension.

10. The crane according to claim 9, wherein one or more spreaders are provided in between the object suspension device and the spreader sheaves so as to determine a radial distance between a central vertical axis of the object suspension device and each spreader sheave.

11. The crane according to claim 10, wherein two of the three departure sheaves are mounted to lateral ends of a transverse beam, the transverse beam being at a center portion thereof mounted to the upper end of the main boom member or to the jib.

* * * * *